US010195842B2

(12) United States Patent
Carreras et al.

(10) Patent No.: US 10,195,842 B2
(45) **Date of Patent: *Feb. 5, 2019**

(54) APPARATUS FOR FORMING HIGH DEFINITION LITHOGRAPHIC IMAGES ON CONTAINERS

(71) Applicant: Ball Corporation, Broomfield, CO (US)

(72) Inventors: Chris Carreras, Erie, CO (US); Kellie M. Hedberg, Broomfield, CO (US)

(73) Assignee: BALL CORPORATION, Broomfield, CO (US)

( * ) Notice: Subject to any disclaimer, the term of this patent is extended or adjusted under 35 U.S.C. 154(b) by 13 days.

This patent is subject to a terminal disclaimer.

(21) Appl. No.: 15/378,768

(22) Filed: Dec. 14, 2016

(65) Prior Publication Data

US 2017/0096001 A1 Apr. 6, 2017

Related U.S. Application Data

(60) Division of application No. 14/686,517, filed on Apr. 14, 2015, now Pat. No. 9,555,616, which is a (Continued)

(51) Int. Cl.
*B41F 7/08* (2006.01)
*B41M 1/40* (2006.01)
(Continued)

(52) U.S. Cl.
CPC ..... *B41F 7/08* (2013.01); *B41F 7/02* (2013.01); *B41F 7/14* (2013.01); *B41F 7/16* (2013.01);
(Continued)

(58) Field of Classification Search
CPC ..... B41F 7/08
(Continued)

(56) References Cited

U.S. PATENT DOCUMENTS 3,098,564 A 7/1963 Fouse et al.
3,252,410 A 5/1966 Stephenson
(Continued)

FOREIGN PATENT DOCUMENTS

CA 2097619 5/1992
CH 654524 2/1986
(Continued)

OTHER PUBLICATIONS

Notice of Grant with machine translation for Chile Patent Application No. 3604-2015, dated Jan. 22, 2018 4 pages.
(Continued)

*Primary Examiner* — Anthony Nguyen
(74) *Attorney, Agent, or Firm* — Sheridan Ross PC

(57) ABSTRACT

The present invention relates to using soft secondary plates and specialty inks in a printing process. More specifically, the present invention relates to an apparatus and methods of using soft secondary plates made of a rubber comprising a saturated chain of polymethylene or a photopolymer material to decorate an exterior surface of cylindrical metallic containers with high definition graphics and other indicia.

20 Claims, 10 Drawing Sheets

Related U.S. Application Data continuation-in-part of application No. 14/301,018, filed on Jun. 10, 2014, now Pat. No. 9,409,433.

(60) Provisional application No. 61/833,799, filed on Jun. 11, 2013.

(51) Int. Cl.

| | |
|---|---|
| ***B41F 7/16*** | (2006.01) |
| ***B41F 17/08*** | (2006.01) |
| ***B41N 1/00*** | (2006.01) |
| ***B41F 7/02*** | (2006.01) |
| ***B41F 17/22*** | (2006.01) |
| ***B41F 7/14*** | (2006.01) |
| ***B41M 1/28*** | (2006.01) |
| ***B41F 17/00*** | (2006.01) |

(52) U.S. Cl.

CPC ..... *B41F 17/002* (2013.01); *B41F 17/08* (2013.01); *B41F 17/22* (2013.01); *B41M 1/28* (2013.01); *B41M 1/40* (2013.01); *B41N 1/006* (2013.01); *B41P 2200/21* (2013.01); *B41P 2217/62* (2013.01)

(58) Field of Classification Search

USPC ..... 101/453

See application file for complete search history.

(56) References Cited

U.S. PATENT DOCUMENTS 3,286,302 A 11/1966 Doering
3,313,409 A 4/1967 Johson
3,357,950 A 1/1971 Powers
3,752,073 A 8/1973 Lorber
3,766,851 A 10/1973 Sirvet et al.
3,782,542 A 1/1974 Scribner
3,923,158 A 12/1975 Fornaa
3,960,073 A 6/1976 Rush
3,983,729 A 10/1976 Traczyk et al.
3,991,673 A 11/1976 Coale et al.
4,048,917 A 9/1977 Skrypek et al.
4,105,122 A 8/1978 Flood et al.
4,132,826 A 1/1979 Dessauer et al.
4,142,462 A 3/1979 Gilgore
4,378,493 A 3/1983 Dorf et al.
4,384,518 A 5/1983 Albin
4,395,946 A 8/1983 Price
4,399,357 A 8/1983 Dorf et al.
4,442,934 A 4/1984 Dorf et al.
4,471,011 A 9/1984 Sporing
4,479,429 A 10/1984 Haryu
4,492,476 A 1/1985 Miyazawa
4,519,232 A 5/1985 Traczyk et al.
4,519,310 A 5/1985 Shimizu et al.
4,589,339 A 5/1986 Fischer
4,620,090 A 10/1986 Ducloux
4,672,893 A * 6/1987 Mammarella, Sr. ..... B41F 5/24 101/153
4,732,027 A 3/1988 Traczyk et al.
4,741,266 A 5/1988 Stirbis et al.
4,774,839 A 10/1988 Caleffi et al.
4,790,662 A 12/1988 Bischkopf et al.
4,872,024 A 10/1989 Nagai et al.
4,884,504 A 12/1989 Sillars
4,889,560 A 12/1989 Jaeger et al.
4,898,752 A 2/1990 Cavagna et al.
4,903,599 A 2/1990 Kubler et al.
4,924,083 A 5/1990 Ishikawa et al.
4,924,107 A 5/1990 Tucker
5,010,814 A 4/1991 Shishikura
5,017,795 A 5/1991 Dower et al.
5,049,432 A 9/1991 Ooms et al.
5,065,905 A 11/1991 Eddy et al.
5,120,126 A 6/1992 Wertz et al.
5,181,471 A 1/1993 Sillars
5,213,043 A 5/1993 Reimers et al.
5,282,306 A 2/1994 Katsuhiro
5,337,659 A 8/1994 Whelan
5,339,731 A 8/1994 Howard et al.
5,351,617 A 10/1994 Williams et al.
5,353,703 A 10/1994 Rieker
5,385,092 A 1/1995 Lewis et al.
5,469,787 A 11/1995 Turner et al.
5,497,900 A 3/1996 Caleffi et al.
5,502,476 A 3/1996 Neal et al.
5,591,255 A 1/1997 Small et al.
5,591,462 A 1/1997 Darling et al.
5,713,288 A 2/1998 Frazzitta
5,771,798 A 6/1998 Shriver
5,806,427 A 9/1998 Niemiro et al.
5,908,505 A 6/1999 Bargenquest et al.
5,919,839 A 7/1999 Titterington et al.
5,970,865 A 10/1999 Horth et al.
5,974,974 A 11/1999 Agnew et al.
5,987,161 A 11/1999 Dowane et al.
6,037,101 A 3/2000 Telser et al.
6,058,839 A 5/2000 Frazzitta
6,079,326 A 6/2000 Strutz et al.
6,139,779 A 10/2000 Small et al.
6,174,937 B1 1/2001 Banning et al.
6,184,988 B1 2/2001 Ferrari
6,196,675 B1 3/2001 Deily et al.
6,238,837 B1 5/2001 Fan
6,309,453 B1 10/2001 Banning et al.
6,312,872 B1 11/2001 Murphy
6,395,123 B1 5/2002 Fromson et al.
6,473,169 B1 10/2002 Dawley et al.
6,494,950 B1 12/2002 Fujita et al.
6,525,333 B1 2/2003 Dawley et al.
6,543,350 B2 4/2003 Gilliam et al.
6,550,389 B1 4/2003 Goto et al.
6,553,907 B2 4/2003 Richards
6,584,895 B1 7/2003 Strauch et al.
6,594,927 B2 7/2003 Witkowski
6,640,713 B2 11/2003 Landsman
6,651,559 B2 11/2003 Haraux et al.
6,779,445 B2 8/2004 Schaede
6,779,455 B2 8/2004 Figov et al.
6,827,019 B1 12/2004 Hieronymus et al.
6,899,998 B2 5/2005 Figov
6,920,822 B2 7/2005 Finan
6,989,226 B2 1/2006 Araki et al.
7,227,166 B2 6/2007 Cochran et al.
7,308,142 B2 12/2007 Sones et al.
7,309,563 B2 12/2007 Paul et al.
7,313,270 B2 12/2007 Sones
7,394,937 B2 7/2008 Sones
7,399,526 B2 7/2008 Dalmais et al.
7,464,642 B2 12/2008 Schaede
7,488,965 B2 2/2009 Cochran et al.
7,667,836 B2 2/2010 Sones et al.
7,684,034 B2 3/2010 Sones et al.
7,691,549 B1 4/2010 Glasser
7,773,214 B2 8/2010 Sones et al.
7,810,922 B2 10/2010 Gervasi et al.
7,821,629 B2 10/2010 Akkerman et al.
7,997,199 B2 8/2011 Watanabe et al.
RE42,715 E 9/2011 Sones
8,014,586 B2 9/2011 Sones et al.
8,034,207 B2 10/2011 Hunahata
8,409,698 B2 4/2013 Byers et al.
8,544,385 B2 10/2013 Schuler-Cossette et al.
9,409,433 B2 8/2016 Carreras
9,475,276 B2 10/2016 Fleischer et al.
9,555,616 B2 1/2017 Carreras et al.
2002/0083855 A1 7/2002 Samworth
2002/0178945 A1 12/2002 Richards
2002/0189471 A1 12/2002 Juffinger et al.
2003/0015105 A1 1/2003 Dewig
2003/0056410 A1 3/2003 Witkowski
2003/0089261 A1 5/2003 Landsman
2003/0101885 A1 6/2003 Jordan

(56) References Cited

U.S. PATENT DOCUMENTS

| | | | | |
|---|---|---|---|---|
| 2003/0150346 | A1 | 8/2003 | Haraux et al. | |
| 2003/0179920 | A1 | 9/2003 | Hooker et al. | |
| 2004/0011234 | A1 | 1/2004 | Figov et al. | |
| 2004/0126682 | A1 | 7/2004 | Dreher et al. | |
| 2004/0161705 | A1* | 8/2004 | Huang | B41C 1/003 430/306 |
| 2004/0173110 | A1 | 9/2004 | Roesch | |
| 2004/0191693 | A1 | 9/2004 | Takamiya | |
| 2005/0098051 | A1 | 5/2005 | Flint et al. | |
| 2006/0019196 | A1 | 1/2006 | Miyoshi | |
| 2006/0121389 | A1 | 6/2006 | Anzures et al. | |
| 2006/0137548 | A1 | 6/2006 | Vetter | |
| 2006/0243146 | A1* | 11/2006 | Schaede | B41F 9/021 101/217 |
| 2007/0084368 | A1 | 4/2007 | Vest et al. | |
| 2009/0186308 | A1 | 4/2007 | Vest et al. | |
| 2008/0002182 | A1 | 1/2008 | Akkerman et al. | |
| 2009/0303307 | A1 | 12/2009 | Yasumatsu | |
| 2010/0031834 | A1 | 2/2010 | Morgavi et al. | |
| 2010/0229737 | A1 | 9/2010 | Ouchi | |
| 2010/0295885 | A1 | 11/2010 | LaCaze | |
| 2010/0319555 | A1 | 12/2010 | Hashimoto et al. | |
| 2011/0079158 | A1 | 4/2011 | Recchia et al. | |
| 2011/0104615 | A1 | 5/2011 | Sievers | |
| 2011/0126760 | A1 | 6/2011 | Daems et al. | |
| 2011/0140010 | A1 | 6/2011 | Akkerman et al. | |
| 2011/0162542 | A1 | 7/2011 | Nakamura et al. | |
| 2011/0255134 | A1 | 10/2011 | Shigeta et al. | |
| 2011/0283905 | A1 | 11/2011 | Sakata | |
| 2012/0048135 | A1 | 3/2012 | Burberry et al. | |
| 2012/0103216 | A1 | 5/2012 | Knisel et al. | |
| 2012/0204746 | A1 | 8/2012 | Fullgraf | |
| 2012/0216689 | A1 | 8/2012 | Cochran et al. | |
| 2012/0238675 | A1 | 9/2012 | Kataura et al. | |
| 2012/0274695 | A1 | 11/2012 | LaCaze et al. | |
| 2012/0315412 | A1 | 12/2012 | Clayton et al. | |
| 2013/0019566 | A1 | 1/2013 | Schach | |
| 2017/0019566 | A1 | 1/2013 | Schach | |
| 2013/0075675 | A1 | 3/2013 | Krutak et al. | |
| 2013/0105743 | A1 | 5/2013 | Owen et al. | |
| 2013/0176358 | A1 | 7/2013 | Yamada et al. | |
| 2013/0208105 | A1 | 8/2013 | Schmidt et al. | |
| 2013/0228086 | A1 | 9/2013 | Baldwin et al. | |
| 2013/0231242 | A1 | 9/2013 | Clayton et al. | |
| 2013/0242276 | A1 | 9/2013 | Schadebrodt et al. | |
| 2013/0340885 | A1 | 12/2013 | Clayton et al. | |
| 2014/0039091 | A1 | 2/2014 | Owen et al. | |
| 2014/0072442 | A1 | 3/2014 | Bowman et al. | |
| 2014/0187668 | A1 | 7/2014 | Owen et al. | |
| 2014/0202348 | A1* | 7/2014 | Fuellgraf | B41N 1/12 101/395 |
| 2014/0210201 | A1 | 7/2014 | Owen et al. | |
| 2014/0212654 | A1 | 7/2014 | Clayton et al. | |
| 2014/0253718 | A1 | 9/2014 | Leitzen et al. | |
| 2014/0272161 | A1 | 9/2014 | Clayton et al. | |
| 2015/0035970 | A1 | 2/2015 | Brumbaugh et al. | |
| 2015/0138295 | A1 | 5/2015 | Lindner et al. | |
| 2015/0174891 | A1 | 6/2015 | Boas et al. | |
| 2015/0183211 | A1 | 7/2015 | Petti et al. | |
| 2015/0290923 | A1 | 10/2015 | Treloar | |
| 2016/0001546 | A1 | 1/2016 | Hughes et al. | |
| 2016/0129687 | A1 | 5/2016 | Boas et al. | |
| 2016/0347048 | A1 | 12/2016 | Carreras | |
| 2017/0013452 | A1 | 4/2017 | Boas et al. | |
| 2017/0157964 | A1 | 6/2017 | Izume | |
| 2017/0334659 | A1 | 11/2017 | Leitzen et al. | |
| 2018/0009216 | A1 | 1/2018 | Egerton et al. | |
| 2018/0009217 | A1 | 1/2018 | Henrik | |
| 2018/0086128 | A1 | 3/2018 | Hughes et al. | |

FOREIGN PATENT DOCUMENTS

| | | |
|---|---|---|
| CN | 101808825 | 8/2010 |
| CN | 102143846 | 8/2011 |
| CN | 103109233 | 5/2013 |
| DE | 19807924 | 8/1998 |
| DE | 10225198 | 1/2004 |
| DE | 202004007783 | 9/2005 |
| DE | 102006025897 | 1/2007 |
| EP | 202928 | 11/1986 |
| EP | 317987 | 5/1989 |
| EP | 545862 | 6/1993 |
| EP | 0641648 | 3/1995 |
| EP | 0717320 | 6/1996 |
| EP | 968491 | 1/2000 |
| EP | 1262316 | 12/2002 |
| EP | 1590177 | 11/2005 |
| EP | 1591270 | 11/2005 |
| EP | 1630600 | 3/2006 |
| EP | 1684990 | 8/2006 |
| EP | 2153991 | 2/2010 |
| EP | 2196314 | 6/2010 |
| EP | 2242595 | 10/2010 |
| EP | 2317387 | 5/2011 |
| EP | 2384890 | 11/2011 |
| EP | 2502753 | 9/2012 |
| EP | 2701912 | 3/2014 |
| EP | 2809521 | 12/2014 |
| EP | 2842747 | 3/2015 |
| EP | 2943339 | 11/2015 |
| GB | 1298205 | 11/1972 |
| GB | 2097331 | 11/1982 |
| GB | 2504370 | 1/2014 |
| GB | 2512678 | 10/2014 |
| JP | S58-49256 | 3/1983 |
| JP | H09-039366 | 2/1997 |
| JP | H09-210924 | 8/1997 |
| JP | H09-295396 | 11/1997 |
| JP | 2000-121580 | 4/2000 |
| JP | 2000-258899 | 9/2000 |
| JP | 2001/030612 | 2/2001 |
| JP | 2002-156338 | 5/2002 |
| JP | 2003-019457 | 1/2003 |
| JP | 2007/076209 | 3/2007 |
| JP | 2008-249668 | 10/2008 |
| JP | 2010-249541 | 11/2010 |
| JP | 2013-508196 | 3/2013 |
| JP | 5690745 | 3/2015 |
| KR | 10-2006-0004679 | 1/2006 |
| WO | WO 1990/02044 | 3/1990 |
| WO | WO 92/09435 | 6/1992 |
| WO | WO 94/07693 | 4/1994 |
| WO | WO 96/41299 | 12/1996 |
| WO | WO 98/17474 | 4/1998 |
| WO | WO 98/41966 | 9/1998 |
| WO | WO 00/27644 | 5/2000 |
| WO | WO 01/12440 | 2/2001 |
| WO | WO 2004/069539 | 8/2004 |
| WO | WO 2005/023545 | 3/2005 |
| WO | WO 2005/047011 | 5/2005 |
| WO | WO 2006/048022 | 5/2006 |
| WO | WO 2008/092940 | 8/2008 |
| WO | WO 2009/044569 | 4/2009 |
| WO | WO 2009/090389 | 7/2009 |
| WO | WO 2012/054655 | 4/2012 |
| WO | WO 2012/148576 | 11/2012 |
| WO | WO 2013/028804 | 2/2013 |
| WO | WO 2013/113616 | 8/2013 |
| WO | WO 2013/115800 | 8/2013 |
| WO | WO 2013/155423 | 10/2013 |
| WO | WO 2014/006517 | 1/2014 |
| WO | WO 2014/008544 | 1/2014 |
| WO | WO 2014/096088 | 6/2014 |
| WO | WO 2014/108489 | 7/2014 |
| WO | WO 2014/128200 | 8/2014 |
| WO | WO 2014/144853 | 9/2014 |
| WO | WO 2014/164796 | 10/2014 |
| WO | WO 2014/199469 | 12/2014 |
| WO | WO 2014/201005 | 12/2014 |
| WO | WO 2015/046119 | 4/2015 |
| WO | WO 2015/101828 | 7/2015 |

(56) References Cited

FOREIGN PATENT DOCUMENTS

| | | |
|---|---|---|
| WO | WO 2016/183452 | 11/2016 |
| WO | WO 2018/013465 | 1/2018 |
| WO | WO 2018/057739 | 3/2018 |

OTHER PUBLICATIONS

Third Party Observations for European Patent Application No. 14810948.1, dated Jan. 29, 2018 5 pages.
Notice of Acceptance for Australia Patent Application No. 2014278307, dated Sep. 13, 2017 3 pages.
English Translation of Official Action for Colombia Patent Application No. 15-304586, dated Aug. 23, 2017 6 pages.
Notice of Allowance for Mexico Patent Application No. MX/a/2015/016969, dated Aug. 17, 2017 2 pages.
English Translation of Official Action for China Patent Application No. 2017061601514530, dated Jun. 21, 2017 9 pages.
Official Action for Russia Patent Application No. 2015156266, dated May 31, 2017 4 pages.
Decision to Grant for Russia Patent Application No. 2015156266, dated Jun. 8, 2017 12 pages.
Official Action for U.S. Appl. No. 15/231,128, dated Jul. 13, 2017 8 pages.
"Chemical milling," Wikipedia, Feb. 13, 2015, retrieved from http://en.wikipedia.org/wiki/Chemical_milling, 6 pages.
"DuPont™ Cyrel®: CyrelTM Digital flex plate Imagers (CDI)" DuPont, 2009, retrieved from http://www2.dupont.com/Packaging_Graphics/en_GB/assets/downloads/pdf/CDI_family_English.pdf, 8 pages.
"DuPont™ Cyrel® DPR: Robust Digital Plate for Highest Quality Printing," DuPont, 2010, retrieved from http://www2.dupont.com/Packaging_Graphics/en_US/assets/downloads/pdf/DP_Cyrel_DS_DPR_us_low.pdf, 2 pages.
"DuPont™ Cyrel® NOWS: Rugged, High-Performance Analog Plate," DuPont, 2007, retrieved from http://www2.dupont.com/Packaging_Graphics/en_US/assets/downloads/pdf/Cyrel_NOWS.pdf, 2 pages.
"EPDM rubber," Wikipedia, Oct. 24, 2014, retrieved from http://enwikipedia.org/wiki/EPDM_rubber, 3 pages.
"Flexographic ink," Wikipedia, Sep. 18, 2014, retrieved from http://en.wikipedia.org/wiki/Flexographic_ink, 2 pages.
"Flexography," Wikipedia, Dec. 15, 2014, retrieved from http://en.wikipedia.org/wiki/Flexographic, 6 pages.
"Laser engraving," Wikipedia, Jan. 16, 2015, retrieved from http://en.wikipedia.org/wiki/Laser_engraving, 10 pages.
"Luminous paint," Wikipedia, Jul. 7, 2014, retrieved from http://en.wikipedia.org/wiki/Luminous_paint, 4 pages.
"Offset Lithography," PrintWiki, retrieved Feb. 9, 2015 from http://printwiki.org/Offset_Lithography, 8 pages.
"Offset printing," Wikipedia, Dec. 11, 2014, retrieved from http://en.wikipedia.org/wiki/Offset_printing, 12 pages.
"Plate," PrintWiki, retrieved Feb. 9, 2015 from http://printwiki.org/Plate, 6 pages.
"Printmaking," Wikipedia, Feb. 12, 2015, retrieved from http://en.wikipedia.org/wiki/Printmaking, 14 pages.
Bodwell et al., "Advancing Flexography: The Technical Path Forward," DuPont, 2011, retrieved from www2.dupont.com/Packaging_Graphics/en_US/assets/downloads/pdf/AdvFlexo_Brochure.pdf, 12 pages.
Mine, "How Offset Printing Works," retrieved on Feb. 9, 2015 from www.howstuffworks.com/offset-printing.htm/printable, 5 pages.
International Search Report and Written Opinion for International Patent Application No. PCT/US14/41713, dated Oct. 10, 2014, 8 pages.
International Preliminary Report on Patentability for International (PCT) Patent Application No. PCT/US2014/041713, dated Dec. 23, 2015 7 pages.
Official Action (English translation) for Chinese Patent Application No. 201480039926.X, dated Oct. 28, 2016, 10 pages.
Official Action (with English translation) for Panama Patent Application No. 90961, dated May 12, 2016, 8 pages.
International Search Report and Written Opinion for International (PCT) Patent Application No. PCT/US16/27576, dated Jul. 22, 2016 8 pages.
Official Action for U.S. Appl. No. 14/301,018, dated May 13, 2015, 5 pages.
Official Action for U.S. Appl. No. 14/301,018, dated Aug. 14, 2015 10 pages.
Official Action for U.S. Appl. No. 14/301,018, dated Dec. 15, 2015 8 pages.
Notice of Allowance for U.S. Appl. No. 14/301,018, dated Apr. 6, 2016 10 pages.
Official Action for U.S. Appl. No. 14/686,517, dated Oct. 15, 2015 5 pages Restriction Requirement.
Official Action for U.S. Appl. No. 14/686,517, dated Jan. 15, 2016 8 pages.
Official Action for U.S. Appl. No. 14/686,517, dated Jul. 6, 2016 9 pages.
Notice of Allowance for U.S. Appl. No. 14/686,517, dated Sep. 13, 2016 9 pages.
Corrected Notice of Allowance for U.S. Appl. No. 14/686,517, dated Sep. 28, 2016 6 pages.
Official Action for U.S. Appl. No. 14/005,873, dated Aug. 26, 2015, 27 pages.
Official Action for Australia Patent Application No. 2014278307, dated Mar. 3, 2017 4 pages.
Official Action for Canada Patent Application No. 2,914,050, dated Jul. 7, 2016 3 pages.
Official Action for Canada Application No. 2,914,050, dated Mar. 8, 2017 3 pages.
Extended Search Report for European Patent Application No. 14810948.1, dated Apr. 11, 2017 10 pages.
Third Party Observations for European Patent Application No. 14810948.1, dated Dec. 21, 2016 5 pages.
Notice of Allowance with English Translation for Japan Patent Application No. 2016-519592, dated Jan. 11, 2017 2 pages.
"Blanket for Offset Printing," Offset printing technology, 2016, 4 pages [retrieved from: www.offsetprintingtechnology.com/sub-categories/blanket-for-offset-printing/].
"Cyrel® DSP High Performance Plate," DuPont, 2016, 2 pages [retrieved online from: www.dupont.com/produts-and-services/printing-package-printing/flexographic-platemaking-systems/brands/cyrel/products/sub-products/cyrel-dsp.html].
"Dry offset Printing," Encyclopaedia Britannica, 2016, 2 pages [retrieved online from: www.britannica.com/technology/dry-offset].
"Offset printing," Offset printing technology, 2016, 4 pages [retrieved online from: www.offsetprintingtechnology.com].
"Offset Printing/Dry Offset," Buse Printing & Packaging, 2016, 1 page [retrieved online from: buseprinting.com/offset_printing.html].
"Offset printing," BusinessDictionary.com, 2015, 2 page [retrieved online from: www.businessdictionary.com/definition/offset-printing.html].
"What is offset printing (offset lithography)?" TechTarget, 2016, 13 pages [retrieved online from: whatis.techtarget.com/definition/offset-printing-offset-lithography].
Notice of Allowance for Canada Patent Application No. 2,914,050, dated Oct. 24, 2017 1 page.
English Translation of Official Action for China Patent Application No. 201480039926.X, dated Jan. 2, 2018 6 pages.
Notice of Allowance with English Translation for Japan Patent Application No. 2017-023060, dated Nov. 14, 2017 2 pages.
International Preliminary Report on Patentability for International (PCT) Patent Application No. PCT/US2016/027576, dated Oct. 26, 2017 19 pages.
Notice of Allowance for U.S. Appl. No. 15/231,128, dated Jan. 5, 2018 8 pages.
"Nitrile rubber," Wikipedia, Jan. 10, 2016, retrieved from http://en.wikipedia.org/wiki/Nitrile_rubber, 6 pages.
Notice of Allowance with English Translation for China Patent Application No. 201480039926.X, dated May 3, 2018 5 pages.
Official Action with machine translation for Japan Patent Application No. 2017-545616, dated Jun. 26, 2018 10 pages.

(56) References Cited

OTHER PUBLICATIONS

Official Action (English translation) for Chinese Patent Application No. 201680021443.6, dated Sep. 18, 2018, 11 pages.
Extended Search Report for European Patent Application No. 16780760.1, dated Sep. 21, 2018 11 pages.

* cited by examiner

14G

APPARATUS FOR FORMING HIGH DEFINITION LITHOGRAPHIC IMAGES ON CONTAINERS

CROSS-REFERENCE TO RELATED APPLICATIONS

This application is a Divisional application of and claims priority to U.S. patent application Ser. No. 14/686,517, filed on Apr. 14, 2015 and entitled "Variable Printing Process Using Soft Secondary Plates and Specialty Inks," which is a Continuation-In-Part application and claims the benefit and priority of U.S. application Ser. No. 14/301,018, filed Jun. 10, 2014, entitled "Printing Process Using Soft Photopolymer Plates," which claims priority under 35 U.S.C. § 119(e) to U.S. Provisional Patent Application Ser. No. 61/833,799, filed Jun. 11, 2013 and entitled "Printing Process Using Soft Photopolymer Plates." Each of these applications is incorporated herein in its entirety by reference.

FIELD OF THE INVENTION

The present invention relates to using soft secondary plates in a printing process for cylindrical substrates. More specifically, the present invention relates to a method and apparatus which use soft secondary plates made of novel materials to decorate the exterior surface of cylindrical metallic containers and provide product differentiation in a printing process.

BACKGROUND

Metallic containers are frequently decorated with an image or indicia, such as a brand name, logo, product information, or design, using a lithographic printing process. In lithographic printing, one or more printing plates (or primary plates) with image regions are attached to a plate cylinder (or press cylinder) of a decorator. The image regions can include both ink receiving regions and areas that do not receive ink. An inker applies ink to the printing plates and the ink adheres to the ink receiving regions. Usually each printing plate receives a particular color of ink from the inker. The decorator also has a blanket cylinder (also known as an offset cylinder, a printing cylinder, or a segment wheel). Secondary plates (or secondary transfer plates or printing blankets) are attached to the blanket cylinder. Decorators used in the metallic container industry typically have from 4 to 12 secondary plates on the blanket cylinder. As the plate cylinder and blanket cylinder are rotated in unison, each of the one or more printing plates contacts a secondary plate and transfers a particular color of ink to the secondary plate. When all of the printing plates have transferred their ink colors and images to the secondary plate, the final lithographic image is formed on the secondary plate. A cylindrical metallic container is then brought into rotational contact with one of the secondary plates of the blanket cylinder and the lithographic image is transferred from the secondary plate to the exterior surface of the cylindrical metallic container.

Lithographic printing methods are generally described in U.S. Pat. Nos. 3,766,851, 4,384,518, 6,550,389, and 6,899,998, each of which are incorporated herein by reference in their entireties. The methods described in these references generally only allow a single lithographic image to be produced from a single set of printing plates. Thus, the methods described in these patents are only efficient for printing the same image onto a large number of cylindrical metallic containers. In order to print a different image on a plurality of cylindrical metallic containers, a new set of printing plates must be installed on the plate cylinder of the decorator, resulting in downtime and decreased efficiency of a production line. Because only one image can be printed without changing the printing plates, it is economically challenging to produce small batches of decorated cylindrical metallic containers with different images.

One example of providing multiple different images from a single set of printing plates is provided in U.S. Pat. No. 5,181,471 to Sillars, which is incorporated herein by reference in its entirety. Sillars generally describes a printing system with engraved images formed in flexographic regions of secondary plates attached to the blanket cylinder.

Another method of providing multiple distinct images using a single set of printing plates is described in International Patent Publication No. WO 2014/008544 by Treloar, which is incorporated herein by reference in its entirety. Treloar generally describes a blanket cylinder with secondary plates that are adapted to have inked regions and non-inked regions. Other methods of providing multiple distinct images in lithographic printing processes are described in International Patent Publication No. WO 2014/006517 by Vilas Boas et al. (Vilas Boas) and International Patent Publication No. WO 2014/128200 by Grahame et al. (Grahame), each of which are incorporated herein by reference in their entireties. However, the lithographic images described by Sillars, Treloar, Vilas Boas, and Grahame using these various techniques do not have sufficient detail to be considered a high quality, high-definition image. Further, none of these patents or patent publications describes the use of specialty inks in the printing process or novel materials used for the secondary plates to create high image quality in a mass production process. The commercial metallic container industry requires high-definition printing in unique applications and requires distinct graphical elements formed by specialty inks that can efficiently be printed with high resolution and detail on the exterior surface of a cylindrical metallic container. These high-definition images and the use of specialty inks are necessary to differentiate products at the point of sale and to attract consumers.

U.S. Patent Application Publication 2014/0210201 to Owen et al. (Owen), which is incorporated by reference herein in its entirety, generally describes the use of thermochromic and photochromic inks to decorate beverage cans. However, Owen teaches the use of ink jet printing to apply the inks to the cans which is generally a slow and non-economical process. In contrast, the commercial container industry requires an apparatus and method capable of decorating beverage containers at significant production speeds of at least several thousand cylindrical metallic containers per minute.

Accordingly, there is an unmet need for a high-definition lithographic printing process that allows multiple images to be printed on an exterior surface of a cylindrical metallic container from a single set of printing plates and secondary plates that uses specialty inks and/or improved plate materials without sacrificing production efficiency or image quality and detail.

SUMMARY OF THE INVENTION

The present process uses soft secondary plates affixed to a blanket cylinder of a decorator to significantly enhance the image quality and detail of lithographic images printed on metallic containers. More specifically, in one embodiment of the present invention, the soft secondary plate is comprised of photopolymer material. An image is transferred to a face of the soft photopolymer plate by exposing the soft photopolymer material with light. The image can be transferred using a computer to plate process or a conventional plate exposure process. This results in a soft secondary plate which has relief areas that do not receive ink and hardened areas forming precise and detailed image areas that will receive ink. In another embodiment of the present invention, the soft secondary plate is comprised of a rubber material comprising a saturated chain of polymethylene or other related materials with similar physical properties. Alternatively, certain pliable plastic materials may be used for the same purpose. Images are formed in the rubber of the soft secondary plate by direct laser engraving or other methods known in the art. Variable types and colors of inks are applied by inkers to one or more different portions of a printing plate to form a first image. The printing plate is then brought into rotational contact with the soft secondary plates and transfers the various types and colors of inks to the soft secondary plates. A container body is then moved into rotational contact with the soft secondary plates and the inks are transferred to the exterior surface of the container body. In some embodiments of the process, the soft secondary plates may also be etched or engraved on the face before, during, or after an image is formed thereon to form one or more recessed portions that do not receive ink. In other embodiments, a varnish may also be applied to one or more portions of the exterior surface of the container body by the soft secondary plates or by a separate varnishing unit. These and other advantages will be apparent from the disclosure of the invention(s) contained herein.

In accordance with one aspect of the present invention, a novel method of using a soft secondary plate in a lithographic printing process to decorate an exterior surface of a metallic container is provided. This includes, but is not limited to, a method generally comprising: (1) forming a first image on a predetermined portion of a top or face portion of the soft secondary plate; (2) removably affixing the soft secondary plate with the first image onto a blanket cylinder of a decorator; (3) attaching a plurality of printing plates to a plate cylinder of the decorator; (4) applying an ink from an inker to at least one of the plurality of printing plates; (5) transferring at least some of the ink from the at least one of the plurality of printing plates to at least a portion of the soft secondary plate; and (6) transferring the ink from the soft secondary plate to the exterior surface of the metallic container, wherein the metallic container is decorated. The soft secondary plate is comprised of one of a rubber comprising a saturated chain of polymethylene, a photopolymer material, and a pliable plastic material In one embodiment, forming the first image on the soft secondary plate comprises removing at least some of a material of the face portion of the soft secondary plate in a direct laser engraving process. In another embodiment, at least some of a material of the face portion of the soft secondary plate is removed to form the first image in one or more of a direct laser engraving process, a mechanical or chemical etching or engraving process, an ink repelling process, a pressure forming process, or by a combination of one or more processes. In one embodiment, the first image formed on the soft secondary plate has a depth of from about 0.0009 inch to about 0.089 inch.

In one embodiment, the ink comprises a specialty ink. The specialty ink may comprise one or more of a thermochromic ink, a photochromic ink, a scented thermochromic ink, a fluorescent ink, a UV ink, a black light ink, an infrared ink, a phosphorescent ink, a pressure sensitive ink, a tactile ink, a thermo-tactile ink, a leuco dye, and a matte ink.

In one embodiment, the rubber of the soft secondary plate comprises an M-class rubber. In another embodiment, the rubber of the soft secondary plate comprises an ethylene propylene diene monomer. In yet another embodiment, the rubber of the soft secondary plate comprises an ethylene propylene rubber.

Optionally, the method may further comprise removably affixing from about 4 to about 12 soft secondary plates onto the blanket cylinder. Each of the about 4 to the about 12 soft secondary plates may have different images. Ink transferred from the about 4 to the about 12 soft secondary plates produces 4 to 12 different images.

In one embodiment, the method may optionally further include removably attaching a plurality of second printing plates to a second plate cylinder of the decorator. A second ink from a second inker is applied to at least one of the plurality of second printing plates. The second ink is a different type or color of ink than the first ink applied by the inker. At least some of the second ink is transferred from the at least one of the plurality of second printing plates to at least a portion of the soft secondary plate and the first image. The first ink and the second ink are then transferred from the soft secondary plate to the exterior surface of the metallic container. Accordingly, the metallic container is decorated with at least some of the first ink and at least some of the second ink.

In accordance with another aspect of the present invention, an apparatus for forming a high-definition lithographic image on an exterior surface of a metallic container is disclosed, the apparatus operable to create multiple lithographic images from a single set of printing plates. The apparatus generally comprises: (1) at least one plate cylinder with an inker; (2) a blanket cylinder; and (3) a support cylinder. The inker is operable to transfer an ink to predetermined portions of one or more printing plates attached to a circumference of the at least one plate cylinder. In one embodiment, one or more of the printing plates are comprised of a rubber comprising a saturated chain of polymethylene, a soft photopolymer material, and a pliable plastic material. One or more soft secondary plates are removably affixed to a circumference of the blanket cylinder. Each of the one or more soft secondary plates is comprised of one of: a rubber comprising a saturated chain of polymethylene; a soft photopolymer material; and a pliable plastic material. Each of the soft secondary plates have an image formed thereon. The blanket cylinder is operable to move the soft secondary plates into rotational contact with the one or more printing plates attached to the at least one plate cylinder. When the soft secondary plates contact the printing plates, ink is transferred from the predetermined portions of the one or more printing plates to at least a portion of the soft secondary plates. The support cylinder includes a plurality of stations adapted to receive metallic containers and is operable to receive the metallic container from a conveyor and move the metallic container into contact with a soft secondary plate affixed to the blanket cylinder. Ink is then transferred from the soft secondary plate to the metallic container to form the high-definition lithographic image on the exterior surface of the metallic container.

In one embodiment, the at least one plate cylinder comprises from about 4 to about 18 plate cylinders. Each of the plate cylinders includes an inker operable to transfer a different color of ink or a different specialty ink to predetermined portions of one or more printing plates attached to each of the plate cylinders. In one embodiment, the specialty ink comprises one or more of a thermochromic ink, a photochromic ink, a scented thermochromic ink, a fluorescent ink, a UV ink, a black light ink, an infrared ink, a phosphorescent ink, a pressure sensitive ink, a tactile ink, a thermo-tactile ink, a leuco dye, and a matte ink.

In one embodiment, the rubber of the soft secondary plates comprises an M-class rubber. In another embodiment, the rubber of the soft secondary plates comprises an ethylene propylene diene monomer. In still another embodiment, the rubber of the soft secondary plates comprises an ethylene propylene rubber.

In one embodiment, each of the one or more soft secondary plates affixed to the blanket cylinder has a distinct image formed thereon. The images are formed on the face portion of the soft secondary plates by one or more of a direct laser engraving process, a mechanical or chemical etching or engraving process, an ink repelling process, a pressure forming process, or by a combination of one or more processes. In one embodiment, when the soft secondary plates are comprised at least partially of a soft photopolymer material, the images may also be formed using a computer to plate (CTP) process, a conventional plate exposure process, or any other suitable method. The images formed on the soft secondary plates may have a depth of from about 0.0009 inch to about 0.089 inch.

It is another aspect of the present invention to provide soft secondary plate adapted to form a high-definition lithographic image on an exterior surface of a metallic container in a printing process. The soft photopolymer plate generally comprises a plate body of a predetermined size. The plate body has a face portion and a back portion. The back portion is adapted to be removably attached to a blanket cylinder of a decorator. At least the face portion of the soft secondary plate comprises one of a rubber comprising a saturated chain of polymethylene, a photopolymer material, and a pliable plastic material. In one embodiment, the plate body is from about 0.04 inch to about 0.1 inch thick.

In one embodiment, the rubber comprises an M-class rubber. In another embodiment, the rubber comprises an ethylene propylene diene monomer. In still another embodiment, the rubber comprises an ethylene propylene rubber.

In one embodiment, an image is formed on the face portion of the soft secondary plate. The image may be formed by at least one of a direct laser engraving process, a mechanical etching or engraving process, an ink repelling process, and a pressure forming process. When the soft secondary plate is comprised at least partially of a soft photopolymer material, the image may also be formed using a computer to plate process, a conventional plate exposure process, or any other suitable method. The image may have a depth of from about 0.0009 inch to about 0.089 inch.

In accordance with one aspect of the present invention, a novel method of using a soft secondary plate in a lithographic printing process to decorate an exterior surface of a metallic container is provided. This includes, but is not limited to, a method generally comprising: (1) forming a first image to be printed onto an exterior surface of the metallic container; (2) transferring the first image to a predetermined portion of a face portion of the soft secondary plate, wherein the soft secondary plate is comprised of one of a photopolymer material, a rubber comprising a saturated chain of polymethylene, and a pliable plastic material; (3) removably affixing the soft secondary plate with the first image onto a blanket cylinder of a decorator; (4) attaching a plurality of printing plates to at least one plate cylinder of the decorator; (5) applying an ink from an inker to at least one of the plurality of the printing plates; (6) transferring at least some of the ink from the at least one of the plurality of printing plates to at least a portion of the soft secondary plate; and (7) transferring the ink from the soft secondary plate to the exterior surface of the metallic container, wherein the metallic container is decorated.

Additionally or alternatively, the method may further comprise removably affixing from about 4 to about 12 soft secondary plates onto the blanket cylinder. The about 4 to the about 12 soft secondary plates may each have different images. Ink transferred from the about 4 to the about 12 soft secondary plates produces 4 to 12 different images on about 4 to the about 12 metallic containers In one embodiment, the face portion of the soft secondary plate may be etched or engraved to form one or more recessed portions. In another embodiment, a second image to be printed onto an exterior surface of the metallic container is formed on the printing plates. The metallic container is then decorated with the first image and the second image.

Transferring the first image to the predetermined portion of the face portion of the soft secondary plate generally comprises: (1) creating a film negative of the first image; (2) placing the film negative on the predetermined portion of the face portion of the soft secondary plate; (3) exposing the soft secondary plate and the film negative to a light source, wherein a material of the soft secondary plate hardens in predetermined locations where light passes through the film negative, and wherein the material of the secondary plate remains unexposed and soft in predetermined locations where the light is blocked by the film negative; (4) removing the film negative from the soft secondary plate; and (5) placing the soft secondary plate in a washing station and cleaning the soft secondary plate to remove the soft, unexposed material of the soft photopolymer plate to reveal the transferred first image.

Additionally or alternatively, transferring the first image to the predetermined portion of the face portion of the soft secondary plate may generally comprise: (1) creating the first image; (2) ablating portions of an opaque mask coating on the face portion of the soft secondary plate to form a negative of the first image; (3) exposing the soft secondary plate to a light source, wherein a polymer material of the soft secondary plate hardens in predetermined locations where the masking coating has been ablated, and wherein the polyomer material of the soft secondary plate remains unexposed and soft in predetermined locations where the light is blocked by the mask coating; and (4) removing the soft, unexposed polymer material of the soft secondary plate to reveal the transferred first image.

In one embodiment, the light source is an ultraviolet light source. In another embodiment, the soft secondary plate and the film negative are exposed to the light source for from about 0.01 minute to about 10 minutes. In one embodiment, the washing station uses a solvent to clean the soft secondary plate. In another embodiment, the washing station uses water to clean the soft secondary plate.

The soft secondary plate comprised of a photopolymer material may be formed of any mixture of materials that harden or form a different texture after exposure to ultraviolet or visible light. In one embodiment, the soft secondary plate is comprised of one of elastomers which are cured using a light-catalyzed photopolymerization process, chloroprene crosslinked with trimethylolpropane triacrylate, and styrene-isoprene rubber with a polyacrylate. In another embodiment, before the first image is transferred to the soft secondary plate, the soft secondary plate has a hardness of from about 40 durometers to about 110 durometers.

In one embodiment, the soft secondary plate is comprised of an M-class rubber. In another embodiment, the soft secondary plate is comprised of an ethylene propylene diene monomer. In yet another embodiment, the soft secondary plate is comprised of an ethylene propylene rubber.

In one embodiment, at least some of a material of the face portion of the soft secondary plate is removed to form the first image in one or more of a direct laser engraving process, a mechanical or chemical etching or engraving process, an ink repelling process, a pressure forming process, or by a combination of one or more processes. In one embodiment, the first image formed on the soft secondary plate has a depth of from about 0.0009 inch to about 0.089 inch.

In one embodiment, the ink comprises a specialty ink. The specialty ink may comprise one or more of a thermochromic ink, a photochromic ink, a scented thermochromic ink, a fluorescent ink, a UV ink, a black light ink, an infrared ink, a phosphorescent ink, a pressure sensitive ink, a tactile ink, a thermo-tactile ink, a leuco dye, and a matte ink.

In one embodiment, each of the different images are formed in a same location on each of the soft secondary plates. In another embodiment, only one of the printing plates attached to the at least one plate cylinder transfers ink to the different images formed on each of the soft secondary plates and each of the other printing plates attached to the at least one plate cylinder transfer ink to other predetermined portions of each of the soft secondary plates.

In one embodiment, the metallic container is generally cylindrical in shape and the first image is transferred to a curved exterior surface of the metallic container. In another embodiment, the metallic container is generally cylindrical in shape and the first image is transferred to a substantially flat exterior surface of the metallic container. In yet another embodiment, the metallic container is not cylindrical in shape and the first image is transferred to a flat exterior surface of the metallic container.

In accordance with another aspect of the present invention, an apparatus for forming a high-definition lithographic image on an exterior surface of a metallic container is disclosed, the apparatus operable to create multiples lithographic images from a single set of printing plates. The apparatus generally comprises: (1) at least one plate cylinder with an inker, the inker operable to transfer ink to predetermined portions of one or more printing plates attached to a circumference of the at least one plate cylinder; (2) a blanket cylinder, the blanket cylinder having one or more soft secondary plates affixed to a circumference of the blanket cylinder, the blanket cylinder operable to move the soft secondary plates into rotational contact with a printing plate attached to the at least one plate cylinder, wherein ink is transferred from the predetermined portions of the printing plate to at least a portion of the soft secondary plates, and wherein the soft photopolymer plates each have an image formed thereon; and (3) a support cylinder, the support cylinder including a plurality of stations adapted to receive metallic containers, the support cylinder operable to receive the metallic container from a conveyor and move the metallic container into contact with a soft secondary plate affixed to the blanket cylinder, wherein ink is transferred from the soft secondary plate to the metallic container to form the high-definition lithographic image on the exterior surface of the metallic container. In one embodiment, the soft secondary plates are comprised of a rubber comprising a saturated chain of polymethylene. In another embodiment, the soft secondary plates are comprised of a soft photopolymer material. In still another embodiment, the soft secondary plates are comprised of a pliable plastic material. In another embodiment, one or more of the printing plates are comprised of one of: a rubber comprising a saturated chain of polymethylene; a soft photopolymer material; and a pliable plastic material.

In one embodiment, the at least one plate cylinder and the support cylinder rotate in a first direction and the blanket cylinder rotates in an opposite second direction. In another embodiment, from about 4 to about 12 soft secondary plates are affixed to the circumference of the blanket cylinder.

In one embodiment, each of the soft secondary plates has a different image formed thereon. In one embodiment, each of the different images are formed in a same location on each of the soft secondary plates. In another embodiment, only one of the printing plates attached to the at least one plate cylinder transfers ink to the different images formed on each of the soft secondary plates. The other printing plates attached to the at least one plate cylinder transfer ink to other predetermined portions of each of the soft secondary plates.

In one embodiment, a second image is formed on the printing plates. Ink is transferred from the second image to the soft secondary plates and then to the exterior surface of the metallic container. In another embodiment, no image is formed on the printing plates but the printing plates convey ink to the soft secondary plates.

In one embodiment, the metallic container is generally cylindrical in shape. In yet another embodiment, the metallic container is not cylindrical in shape. In one embodiment, the ink is transferred from the soft secondary plate to one or more of a generally cylindrical exterior surface and a non-cylindrical exterior surface of the metallic container.

In one embodiment, when the soft secondary plate is comprised of a photopolymer material, the images are generally formed on the soft secondary plates by: (1) creating a film negative of each different image; (2) placing the film negatives on predetermined portions of the soft secondary plates; (3) exposing the soft secondary plates and the film negatives to a light source; (4) removing the film negatives from the soft secondary plates; and (5) washing the soft secondary plates to remove unexposed soft material of the soft secondary plates to reveal the different images. In another embodiment, the images are generally formed on the soft secondary plates by at least one of: a direct laser engraving process; a mechanical or chemical etching or engraving process; an ink repelling process; a pressure forming process; and a combination of one or more processes.

In one embodiment, the ink comprises a specialty ink. The specialty ink may be one or more of a thermochromic ink, a photochromic ink, a scented thermochromic ink, a fluorescent ink, a UV ink, a black light ink, an infrared ink, a phosphorescent ink, a pressure sensitive ink, a tactile ink, a thermo-tactile ink, a leuco dye, and a matte ink.

In still another embodiment, one of the printing plates has an area aligning with and operable to transfer ink to the different images on each of the soft secondary plates. Each of the other printing plates have a relief area aligning with the different images on each of the soft secondary plates, and the relief areas will not transfer ink to the different images. The area of the one printing plate and the relief areas of the other printing plates are located in corresponding locations on all of the printing plates and have the same general size and shape. In one embodiment, the area and the relief area have a shape selected from the group consisting of a parallelogram, a square, a rectangle, a circle, or any combination thereof. In a more preferred embodiment, the area and the relief area have a generally rectangular shape.

It is another aspect of the present invention to provide soft secondary plate adapted to form a high-definition lithographic image on an exterior surface of a metallic container in a printing process. The soft secondary plate generally comprises a plate body comprised of a photopolymer material of a predetermined size and hardness, the plate body having a face portion and a back portion, wherein the back portion is adapted to be attached to a blanket cylinder of a decorator. In one embodiment, the plate body is from about 0.04 inch to about 0.1 inch thick. In one embodiment, the metallic container has a body with a generally cylindrical shape.

Optionally, an image may be formed on the face portion of the soft secondary plate by creating a film negative of the image. The film negative is placed on a predetermined portion of the face portion. The face portion and the film negative are exposed to a light source. The film negative is removed from the face portion, and subsequently the soft secondary plate is cleaned to remove unexposed soft material from the face portion. In one embodiment, before the image is formed on the face portion, the soft secondary plate has a hardness of from about 40 durometers to about 110 durometers. In addition, images may be formed on the face portion of the soft secondary plate by one or more of a direct laser engraving process, a mechanical or chemical etching or engraving process, an ink repelling process, a pressure forming process, or by a combination of one or more processes.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

These and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described below. Further, the Summary of the Invention is neither intended nor should it be construed as representing the full extent and scope of the present invention. The present invention is set forth in various levels of detail in the Summary of the Invention, and, in the attached drawings and the Detailed Description of the invention and no limitation as to the scope of the present invention is intended to either the inclusion or non-inclusion of elements, components, etc. in this Summary of the Invention. Additional aspects of the present invention will become more readily apparent from the detailed description, particularly when taken with the drawings.

Although generally referred to herein as "metallic can," "metallic containers," and/or "cylindrical metallic containers," it should be appreciated that the current process may be used to decorate any variety or shape of containers or other articles of manufacture, including generally cylindrical surfaces and non-cylindrical surfaces (including flat substrates) whether made of metal or other materials.

As used herein, the phrase "specialty inks" may include, but is not limited to, one or more colors or types of thermochromic ink, photochromic ink, scented thermochromic ink, fluorescent ink, UV ink, black light ink, infrared ink, phosphorescent ink, pressure sensitive ink, tactile ink, thermo-tactile ink, leuco dye, matte ink, and any other type of ink, dye, or varnish that changes appearance, color, phase, and/or texture in response to temperature changes or exposure to light or pressure.

A "thermochromic ink," as used herein, may include, but is not limited to, any ink of a first predetermined color that can undergo reversible or irreversible change to a second and/or third predetermined color in response to temperature changes.

As used in the present application, a "photochromic ink" may comprise, but is not limited to, any ink of a first predetermined color that can undergo reversible or irreversible change to a second and/or third predetermined color in response to the exposure of light of various wavelengths.

A "scented thermochromic ink," by way of illustration only, includes, but is not limited to, any ink of any color that releases a predetermined scent in response to temperature changes.

A "fluorescent ink," as used in the present application, may include, but is not limited to, any ink that absorbs ultraviolet energy (light) of various wavelengths and, in response, transmits longer waves in a visible spectrum producing light (or "glow") in a predetermined color. Fluorescent inks glow under black light and provide a "day glow."

As used herein, a "phosphorescent ink" includes, but is not limited to, any ink that absorbs light of various wavelengths and produces light of a predetermined color in response. Phosphorescent inks produce light in a manner similar to fluorescent inks; however, phosphorescent inks continue to produce light, or "glow," once charged by light source even if the light source is removed. Phosphorescent inks may also be known as "glow in the dark ink."

As used herein, a "black light ink" includes, but is not limited to, any ink that includes a phosphor that absorbs energy from UV radiation and, in response, emits visible light.

A "pressure sensitive ink" as used in the present application may include, but is not limited to, any ink of a first predetermined color that can change to a second and/or third predetermined color upon receiving a predetermined amount of pressure. The pressure sensitive ink may include capsules containing inks of different colors. When a pre-determined amount of pressure is applied to the pressure sensitive ink, the capsules rupture and the different colors released from the capsules mix, changing the color of the pressure sensitive ink.

As used in the present application, a "matt ink" may include, but is not limited to, any ink of any predetermined color that has a finish that scatters rays of light more (or has less "gloss") when applied to a substrate than other non-matt inks (or "glossy" inks) that reflect more light as parallel rays.

References made herein to "lithographic printing" or aspects thereof should not necessarily be construed as limiting the present invention to a particular method or type of printing. It will be recognized by one skilled in the art that the present invention may be used in other printing processes such as offset printing, dry offset printing, gravure printing, intaglio printing, screen printing, and inkjet printing.

As used herein, a soft secondary plate may be comprised of photopolymer material, rubber comprising a saturated chain of polymethylene (hereinafter "rubber"), various forms of pliable plastic materials, or any other related materials with similar physical properties. The soft secondary plate may be or any size or shape and may be round or a sleeve adapted to fit around a circumference of a blanket cylinder.

The phrases "photopolymer plates," "soft photopolymer plates," "soft photopolymer material," and "soft photopolymer blankets" may be used interchangeably and generally refer to plates or blankets including a photopolymer material. Thus, the soft photopolymer plate may be a photopolymer printing plate that is a digital plate, a conventional analog plate, or a cylinder coated with a photopolymer.

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

BRIEF DESCRIPTION OF THE DRAWINGS

The accompanying drawings, which are incorporated in and constitute a part of the specification, illustrate embodiments of the invention and together with the Summary of the Invention given above and the Detailed Description of the drawings given below, serve to explain the principles of these embodiments. In certain instances, details that are not necessary for an understanding of the disclosure or that render other details difficult to perceive may have been omitted. It should be understood, of course, that the invention is not necessarily limited to the particular embodiments illustrated herein. Additionally, it should be understood that the drawings are not necessarily to scale.

Figure 1A:
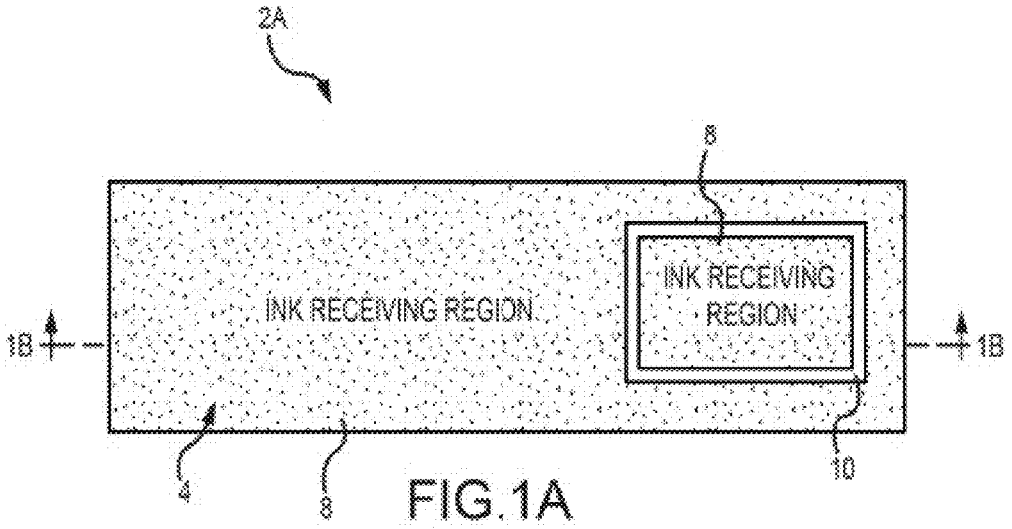
FIG. 1A is a top plan view of a printing plate with an engraved or etched area according to one embodiment of the present invention.

To assist in the understanding of one embodiment of the present invention the following list of components and associated numbering found in the drawings is provided herein:

| Number | Component |
|---|---|
| 2 | Printing plate |
| 4 | Face portion |
| 6 | Back portion |
| 8 | Ink receiving region |
| 10 | Non-ink region |
| 12 | Relief area |
| 14 | Soft secondary plate |
| 16 | Ink receiving region |
| 18 | Image |
| 20 | Relief area |
| 22 | Screened area |
| 24 | Decorator |
| 26 | Plate cylinder |
| 28 | Inker |
| 30 | Rollers |
| 32 | Blanket cylinder |
| 34 | Metallic container |
| 36 | Conveyor |
| 38 | Support cylinder |
| 40 | Station for metallic container |
| 42 | Storage facility |
| 44 | Container surface |
| 46 | Non-inked portion |
| 48 | Varnish unit |
| 50 | Curing unit |

DETAILED DESCRIPTION

The present invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Figure 1B:
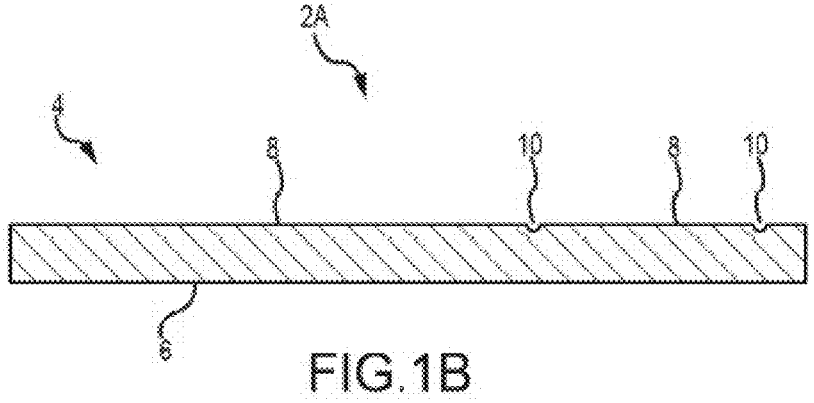
FIG. 1B is a cross-sectional elevation view of the printing plate of FIG. 1A taken along line 1B.

Referring now to FIGS. 1A and 1B, a printing plate 2A is illustrated. The printing plate 2A has a face portion 4 and a back portion 6. One or more ink receiving regions 8 adapted to receive and transfer ink to a soft secondary plate are formed in the face portion 4 by any means known to those of skill in the art. The inked receiving regions 8 of the printing plate 2A transfer a single tone, image, type of ink, or text to the soft secondary plate during a printing process. One or more non-ink regions 10 may be formed in the printing plate. The non-ink regions 10 may be formed by engraving, cutting, etching, and/or removing selected portions from the face portion 4 of the printing plate 2A to form depressions in the face portion. Additionally or alternatively, non-ink regions 10 may be treated to be hydrophilic to prevent ink from adhering to the printing plate 2A as is known by those of skill in the art. The non-ink regions 10 will not receive or transfer ink to the soft secondary plate. Although the non-ink region 10 illustrated in FIG. 1A is rectangular, one skilled in the art will recognize that any shape of non-ink region can be formed on the printing plate 2A, such as a circle, square, or star, an irregular shape and/or combinations thereof. The size and the location of the non-ink region 10 may also be varied. The printing plate 2A may have a common content with the other printing plates 2 used in the printing process to form a final image that will be transferred first to the soft secondary plate and then to a metallic container.

Figure 2A:
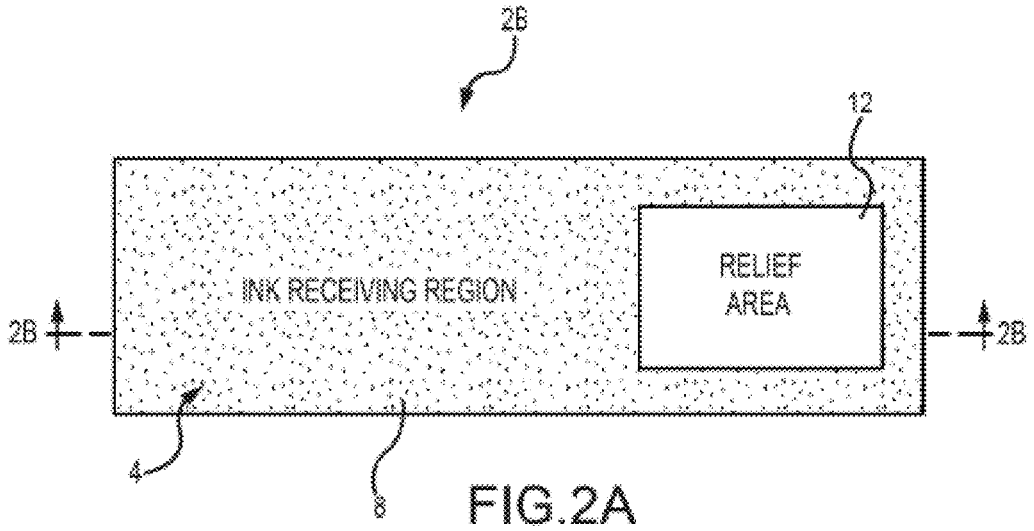
FIG. 2A is a top plan view of a printing plate with a relief area according to an embodiment of the present invention.
Figure 2B:
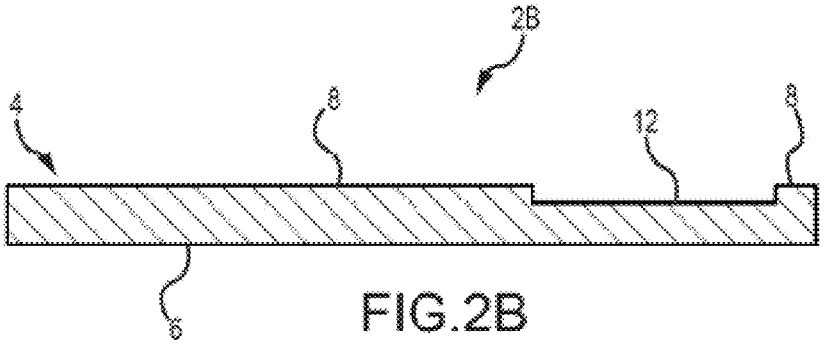
FIG. 2B is a cross-sectional elevation view of the printing plate of FIG. 2A taken along line 2B.

Printing plates 2B may also be formed with a relief area 12, as illustrated in FIGS. 2A and 2B. The relief area 12 can be formed by removing a portion of the face portion 4 of the plate 2B. Additionally or alternatively, the relief area 12 can be formed or treated to be hydrophilic to prevent ink from adhering to the printing plate 2B. The relief area 12 will not accept ink and therefore will not transfer ink to the soft photopolymer plates. The size, location, and shape of the relief area 12 may align with the size, location, and shape of the non-ink region 10 of the printing plate 2A illustrated in FIGS. 1A and 1B. More than one relief area may be formed in each printing plate 2. Additionally or alternatively, printing plates 2 may include both relief areas 12 and non-ink regions 10. In one embodiment, one or more of the printing plates 2 include a face portion 4 comprising a photopolymer material. Images, non-ink regions 10, and relief areas 12 may be formed on the face portion 4 of a printing plate or blanket material comprising a photopolymer material as described below in conjunction with FIGS. 3 and 4.

After one or more of the ink receiving regions 8, non-ink regions 10, and/or relief areas 12 are formed on a printing plate 2, the plate 2 is attached to a plate cylinder of a decorator, discussed below in conjunction with FIG. 5. Optionally, more than one color of ink and one or more specialty inks may be used in conjunction with a corresponding inker in the printing process to form the final image. Each individual color of ink and type of specialty ink is applied by different plate cylinders. The printing plates of each plate cylinder will only receive one color or type of ink from an inker associated with each plate cylinder.

Figure 3A:
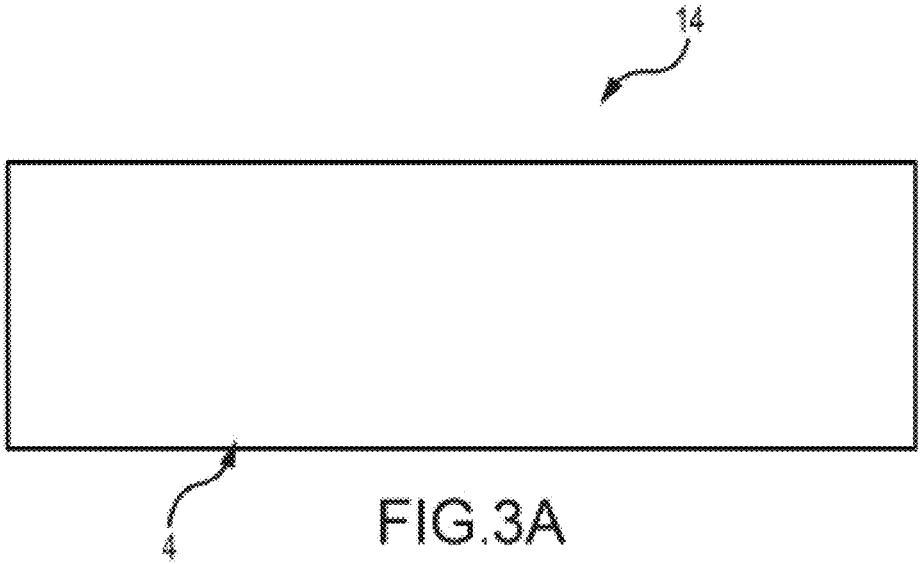
FIG. 3A is a top plan view of a soft secondary plate before an image is formed thereon.
Figure 3B:
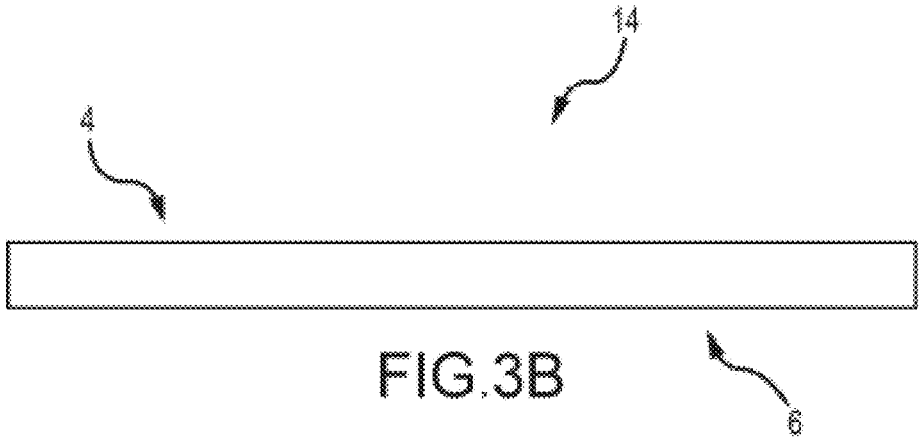
FIG. 3B is a side elevation view of the soft secondary plate of FIG. 3A.

FIGS. 3A and 3B illustrate a soft secondary plate 14 before an image has been formed on the face portion 4 of the plate. Although the soft secondary plate 14 illustrated in FIGS. 3A and 3B has a generally rectangular shape, soft secondary plates are supplied in a varied of sizes and shapes that are suitable for use with the present invention. In one embodiment of the present invention, the soft secondary plate 14 has a thickness of about 0.04 inch to about 0.1 inch. In another embodiment, the thickness of the soft secondary plate is from about 0.060 inch to about 0.090 inch. In another embodiment, the soft secondary plate is about 0.05 inch thick. In still another embodiment, the soft secondary plate is about 0.0725 inch thick. As will be appreciated by those of skill in the art, soft secondary plates of any other suitable thicknesses may also be used with the present invention. Optionally, the soft secondary plates may include a Mylar backing. However, one of skill in the art will appreciate that backings of other materials, or no backing, may be used with the soft secondary plates 14. Further, an adhesive transfer tape or adhesive stickyback may be added to the back portion 6 of the soft secondary plate 14.

In one aspect of the present invention, at least the face portion 4 of the soft secondary plate 14 may be comprised of rubber comprising a saturated chain of polymethylene or other similar materials with similar physical properties. In one embodiment, the rubber comprises an M-class rubber. It will be appreciated by those of skill in the art that an M-class rubber refers to rubbers in American Society for Testing and Materials (ASTM) standard D-1418. In another embodiment, the rubber comprises an ethylene propylene diene monomer, known to those of skill in the art as EPDM rubber. EPDM rubber is a durable, synthetic rubber. In yet another embodiment, the rubber comprises an ethylene propylene rubber and is known to those of skill in the art as EPR and/or EPM rubber. In another aspect of the present invention, at least the face portion 4 of the soft secondary plate 14 may be comprised of pliable plastic materials.

In another aspect of the present invention, at least the face portion 4 of the soft secondary plate 14 may be comprised of a photopolymer material. Suitable soft photopolymer plates are commercially available from a variety of sources as will be appreciated by one skilled in the art. Examples of soft photopolymer plates used for high quality printing on flexible packaging are the Cyrel® NOWS and the Cyrel® DPR plates made by DuPont™ and described in "DuPont™ Cyrel® NOWS, Rugged, High-Performane Analog Plate," available at http://www2.dupont.com/Packaging_Graphics/ en_US/assets/downloads/pdf/Cyrel_NOWS.pdf and "DuPont™ Cyrel® DPR, Robust Digital Plate for Highest Quality Printing," available at http://www2.dupont.com/Packaging_Graphics/en_US/assets/downloads/pdf/DP_Cyrel_DS_DPR_us_low.pdf, which are each incorporated herein by reference in their entireties.

In one embodiment, the soft photopolymer plates have a hardness of from about 40 durometers to about 110 durometers. In a preferred embodiment, the hardness of the soft photopolymer plates is from about 60 durometers to about 100 durometers. In another preferred embodiment, the hardness of the soft photopolymer plates is from about 50 durometers to about 90 durometers. However, soft photopolymer plates that are harder or softer may be used with the method of the present invention. In one embodiment, the hardness of the soft photopolymer plates is measured after the plates have been cured and an image formed thereon as described below.

The soft photopolymer plate may be made of any photocurable material, whether made of a polymer or not. One example is a UV-curable material. Another example is made of a material cured by light of a different wavelength, not necessarily UV light. Although many such plates are made of polymer compositions today, the current invention is applicable to plates made of any material and composition that are curable by light of a desired wavelength. In one embodiment, the photopolymer plate is comprised of elastomers which are cured using a light-catalyzed photopolymerization process. In another embodiment, the photopolymer plate is comprised of chloroprene cross-linked with trimethylolpropane triacrylate. In still another embodiment, the photopolymer plate is comprised of styrene-isoprene rubber with a polyacrylate. Still other embodiments may use soft photopolymer plates comprised of other suitable light-curable materials known to those skilled in the art or developed in the future.

Soft photopolymer plates have primarily been used for creating high resolution graphics on flexible plastic packaging (such as soft plastic vegetable and produce bags), tags, labels, folding cartons, and tissue wrappers. Soft photopolymer plates are not known to have been used in the metallic container industry due to the significant challenges of high speed printing on an exterior surface of a metallic substrate.

Figure 4A:
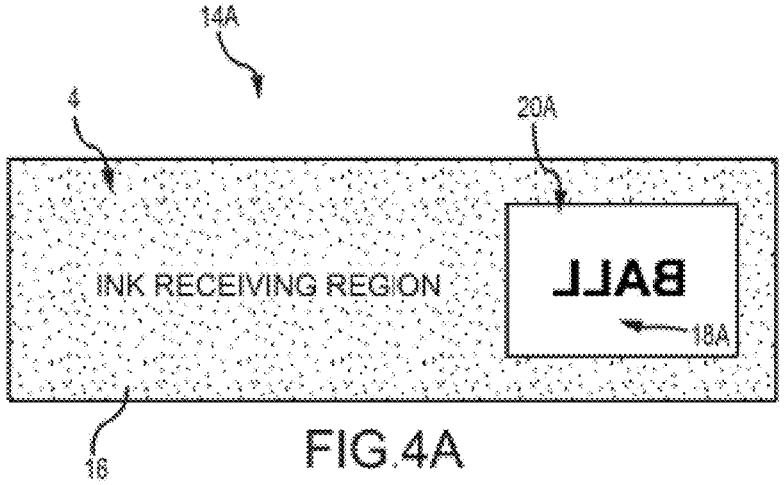
FIG. 4A is a top plan view of a soft secondary plate with an image formed thereon according to one embodiment of the present invention.
Figure 4B:
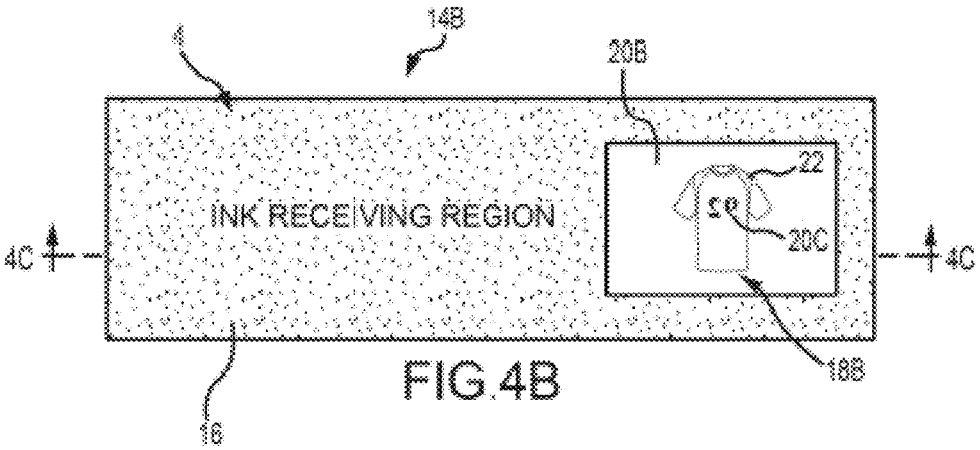
FIG. 4B is a top plan view of a soft secondary plate with a second image formed thereon according to another embodiment of the present invention.
Figure 4C:
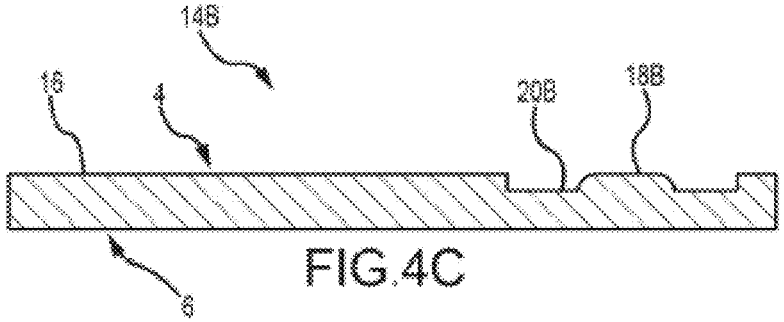
FIG. 4C is a cross-sectional elevation view of the soft secondary plate of FIG. 4B taken along line 4C.

Referring now to FIGS. 4A-4C, soft secondary plates 14 are illustrated with images 18 formed thereon. The face portions 4 of the soft secondary plates 14A, 14B include ink receiving regions 16. An image 18A of the word "BALL" is formed on the soft secondary plate 14A. An image 18B of a sports jersey is formed on the other soft secondary plate 14B.

The process of forming the image 18 to be printed onto the exterior surface of the metallic container on the soft secondary plates 14 depends on the material of the soft secondary plate. When the soft secondary plates 14 are comprised at least partially of rubber, the image 18 is formed on (or transferred to) the soft secondary plate 14 by any process known to one of skill in the art (or developed in the future) including, without limitation, a direct laser engraving (DLE) process, a mechanical or chemical etching or engraving process, an ink repelling process, a pressure forming process, or by a combination of processes.

In the DLE process, a portion of the rubber material of the soft secondary plate 14 is ablated, or otherwise removed, by a laser. The time required to form the image on the rubber soft secondary plate 14 varies based on the size and complexity of the image, the depth and shading of the image, and also upon the composition of the rubber of the soft secondary plate. In one embodiment, the processing time required to form the image 18 in the rubber using the DLE process is from approximately 10 minutes to approximately 3 hours. The rubber soft secondary plate 14 may be affixed to a cylindrical surface while the image is formed using the DLE process. The cylindrical surface has a radius of curvature approximately equal to the radius of curvature of the blanket cylinder of the decorator. Forming the image 18 in the rubber using the DLE process is similar to using a laser engraving and cutting system, such as an Epilog laser to burn an image in a substrate. However, the DLE process offers higher image resolutions and the ability to control the height of screened dots that compose the image (known as the "dot deck height").

In the etching or engraving process, predetermined portions of the rubber of the soft secondary plate 14 are removed to form the image. In a mechanical etching or engraving process, a tool is used to remove the predetermined portions of the rubber. The tool may include a cutting tool, a rotating bit, an abrasive tool, a fluid tool, or any other type of tool operable to remove a predetermined amount of rubber from the face portion 4 of the soft secondary plate 14. The fluid tool may direct a high pressure stream into the face portion of the soft secondary plate. The high pressure stream of the fluid tool can include at least one of a gas, a liquid, and a solid selected to remove the rubber from the face portion of the soft secondary plate 14. Optionally, the tool may be heated to a predetermined temperature as the image is formed on the rubber soft secondary plate 14.

In a chemical etching or engraving process, a chemical is used to remove the predetermined portions of the rubber. A masking material may be applied to the rubber of the soft secondary plate 14 to ensure that the chemical only contacts and removes the predetermined portions of the rubber to form the image. The masking material is selected to adhere to the rubber and is inert with respect to the chemical to protect non-image areas of the rubber. In one embodiment, the masking material may be applied to the entire face portion of the soft secondary plate 14. The masking material is then selectively removed from the areas forming the image. In another embodiment, the masking material is only applied to non-image areas on the face portion 4 of the soft secondary plate. The chemical is then applied to the face portion 4 and contacts the image areas not protected by the masking material. After a predetermined amount of time, the chemical is removed or neutralized and the masking material is removed from the soft secondary plate 14. Optionally, the soft secondary plate 14 may be at least partially immersed in a bath of the chemical. In another embodiment, no masking material is used and the chemical is selectively applied to the predetermined portions of the rubber.

When the image is formed using the ink repelling process, predetermined portions of the rubber soft secondary plate 14 are adapted to be receptive or repellant to ink. In one embodiment, a chemical or a material that repels or attracts ink is applied to predetermined portions of the rubber of the soft secondary plate 14 to form the image. In another embodiment, before the image is formed on the soft secondary plate 14, the face portion 4 of the plate includes a coating that repels or attracts ink. Predetermined portions of the coating are selectively removed from the rubber soft secondary plate 14 to form the image. The image formed using the ink repelling process is comprised of areas that attract ink and other areas that repel ink. In one embodiment, the image may include areas that attract (or repel) at least one type of ink and repel (or attract) at least one other type of ink.

In the pressure forming process, the image is first formed on a surface of a master material. The master material may comprise a metal, a plastic, a photopolymer material, or any other suitable material. The rubber of the soft secondary plate 14 is pressed against the image on the master material for a predetermined amount of time to transfer the image from the master material to the rubber soft secondary plate 14. The soft secondary plate 14 with the image is then removed from the master material. The rubber of the soft secondary plate 14 and/or the master material may be heated before the soft secondary plate 14 is pressed against master material. In one embodiment, the soft secondary plate and the master material are heated to a temperature of approximately 310° F. In another embodiment, the soft secondary plate 14 and the master material are pressed together at a pressure of approximately 1,000 psi.

After the image 18 is formed on the rubber soft secondary plate 14, the soft secondary plate 14 may be cleaned by any suitable method to remove debris from the face portion 4. In one embodiment, a pressurized gas is used to remove the debris from the soft secondary plate 14. In another embodiment, the debris is removed from the soft secondary plate 14 with a liquid, such as water or a solvent.

When the image 18 is formed on the face portion 4 of the rubber soft secondary plate 14, the face portion 4 may have relief areas 20 that will not receive ink and images 18 that can receive ink. The image 18 formed on the rubber of the soft secondary plate 14 can be three dimensional and have different depths in the face portion 4. The image 18, or portions of the image, may have a depth of about 0.0009 inch to about 0.089 inch. In a more preferred embodiment, the depth of the image 18, or within portions of an image 18, is from approximately 0.001 inch to approximately 0.084 inch deep.

When the soft secondary plates 14 are comprised at least partially of a photopolymer material, the images 18A, 18B are formed of exposed and hardened material of the soft photopolymer plates with a computer to plate (CTP) process, a conventional plate exposure process, or any other suitable method. A piece of Mylar is generally used as a backing for the soft photopolymer plate 14, although other materials commonly known by one skilled in the art may also be employed as a backing. An image 18 to be printed onto an exterior surface of the metallic container is formed.

In the conventional plate exposure process, a film negative of the image 18 is created. The film negative is placed on a predetermined portion of the face portion 4 of the soft photopolymer plate 14. The soft photopolymer plate 14 with the film negative is then placed into an exposure device that exposes the soft photopolymer plate and the film negative to a light source. The film negative acts as a negative mask that blocks and prevents some of the light from reaching the face portion 4 of the soft photopolymer plate 14. The light shines through the clear sections of the film negative and hardens the material of the soft photopolymer plate 14. Exposure time to an ultraviolet light source may range from approximately 0.01 minute to approximately 10 minutes.

The material on the face portion 4 of the soft photopolymer plate 14 hardens where light passes through the film negative and strikes the face portion 4. Portions of the soft photopolymer plate 14 that are not covered by the film negative are also exposed to the light and harden. The material on the face portion of the soft photopolymer plate 14 under the areas of the film negative that block the light, or some of the light, remain unexposed and soft.

Using the CTP process, the image 18 is transferred directly to the plate in a digital imager apparatus. The digital imager apparatus ablates, or otherwise removes, portions of an opaque mask coating on the face portion 4 of the soft photopolymer plate 14 to form a negative of the image 18. The soft photopolymer plate 14 is then placed into an exposure device that exposes the soft photopolymer plate to a light source. The exposure device may be the same as, or similar to, the exposure device used in the conventional plate exposure process described above. Portions of the mask coating that were not ablated block light and prevent the light from reaching the face portion 4 of the soft photopolymer plate 14. The polymer material of the soft photopolymer plate 14 under remaining portions of the mask coating remains unexposed and soft. Light from the exposure device contacts the polymer material of the soft photopolymer plate in the image areas where the mask coating has been removed and hardens the material of the soft photopolymer plate 14. Exposure time to an ultraviolet light source may range from approximately 0.01 minute to approximately 10 minutes. An example of the CTP process is described in "Advancing Flexography, The Technical Path Forward" by Ray Bodwell and Jan Scharfenberg, available at http://www2.dupont.com/Packaging_Graphics/en_US/assets/downloads/pdf/Adv-Flexo_Brochure.pdf, which is herein incorporated by reference in its entirety. Examples of suitable digital imager apparatus are described in "Cyrel™ Digital flex plate Imagers (CDI)," available at http://www2.dupont.com/Packaging_Graphics/en_GB/assets/downloads/pdf/CDI_family_English.pdf, which is herein incorporated by reference in its entirety.

Once the image is transferred to the soft photopolymer plate 14 using either the CTP process or the conventional plate exposure process, the soft, unexposed polymer material on the face portion 4 of the exposed soft photopolymer plate 14 is removed. In one embodiment, the exposed soft photopolymer plate 14 is placed in a washing station. The unexposed, soft polymer material on unexposed areas of the face portion 4 of the soft photopolymer plate 14 is removed by washing and scrubbing the face portion 4. The washing station may include either water or a solvent, such as Cyrel Nutre-Clean. As will be appreciated, other solutions and solvents may be used in the washing station. In another embodiment, the unexposed polymer material is removed from the face portion by a post processing apparatus that does not use solvents and/or other liquids. The post processing apparatus may use thermal energy and a developer roll to remove the unexposed polymer material. After the soft, unexposed polymer material is removed, the soft photopolymer plate 14 may be exposed to light a second time to complete polymerization and ensure all areas of the plate have been hardened and to attain maximum durability.

When the unexposed soft material on areas of the face portion 4 of the soft photopolymer plate 14 have been removed, the face portion 4 will have relief areas 20 that will not receive ink and hardened areas forming images 18 that can receive ink. The image 18 formed on the soft photopolymer plate can be three dimensional and have different depths in the face portion 4 depending on the amount of light that passed through the film negative or the masking coating. The image 18, or portions of the image, have a depth of about 0.0009 inch to about 0.089 inch. In a more preferred embodiment, the depth of the image 18, or within portions of an image 18, is from approximately 0.001 inch to approximately 0.084 inch deep.

In some embodiments, the soft photopolymer plates 14 may also be etched or engraved on the face portion 4 before, during, or after the curing process to form one or more additional recessed portions. The etched or engraved areas may be formed using a laser or any other means known by those of skill in the art.

Figure 6A:
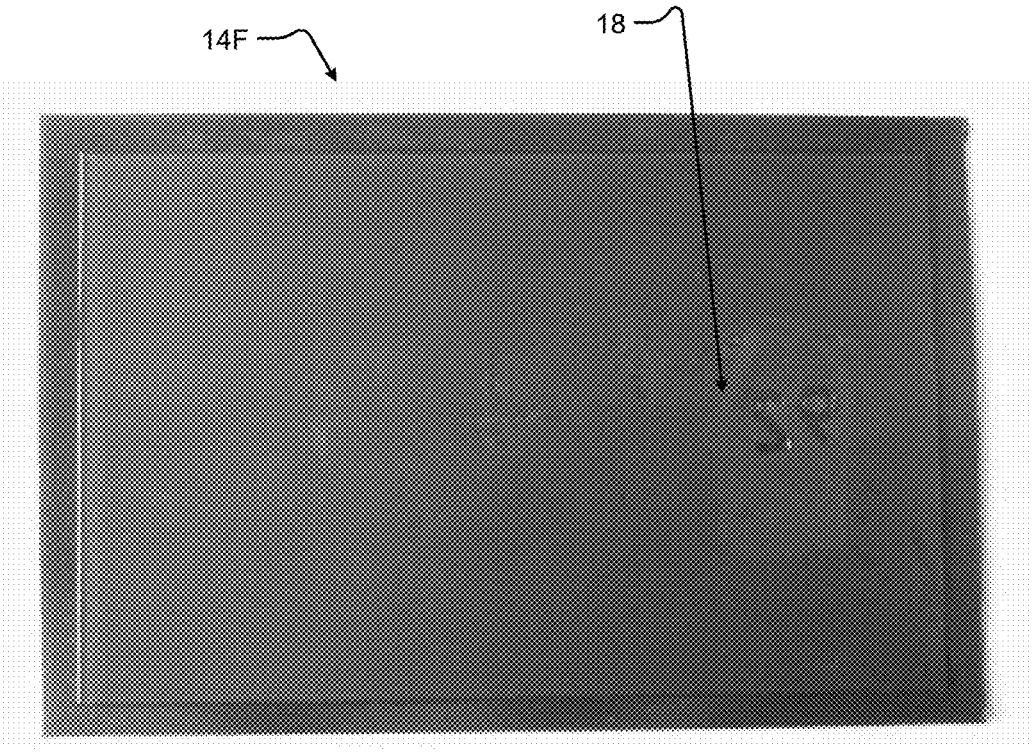
FIG. 6A is a photograph of a soft secondary plate comprised of a photopolymer material with an image formed thereon according to various embodiments of the present invention.
Figure 6B:
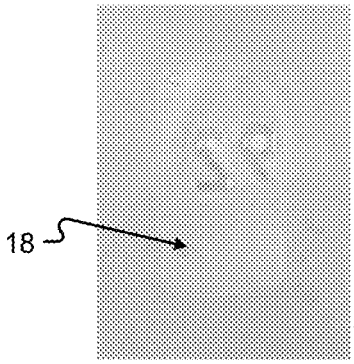
FIG. 6B is an enlarged photograph of the image formed on the soft secondary plate of FIG. 6A.

The images 18 have a maximum thickness equal to the original thickness of the soft secondary plate 14. The images 18 can be surrounded by relief areas 20. When the soft secondary plate 14 is comprised at least partially of a photopolymer material, the relief areas 20 comprise portions of the photopolymer material that were not exposed and therefore remained soft. The unexposed, soft material of the soft photopolymer plates is subsequently removed to form the relief areas 20. The size, location, and shape of the relief area formed in the soft secondary plates 14 may align with the size, location, and shape of the non-ink region 10 of the printing plate 2A illustrated in FIG. 1A and the relief area 12 of the printing plate 2B illustrated in FIG. 2A. The relief areas 20 of the soft secondary plates 14 will not accept ink from the printing plates 4 and may be used to create unique, undecorated areas (or non-inked areas) on the metallic container. The image 18 can include a relief area 20C that will not receive ink and can also include screened areas 22 that receive less ink than other portions of the image as illustrated in FIG. 4B. Although FIGS. 4A, 4B, and 4C illustrate an image surrounded by a relief area, it should be understood that an image 18 may be formed on the soft secondary plate with no relief area surrounding the image 18, as shown in FIGS. 6A and 6B. Further, it will be understood by one of skill in the art that a relief area can be of any desired size or shape and more than one relief area 20 may be formed on the soft secondary plate.

After the image 18 has been formed on the face portion 4 of the soft secondary plate 14, an adhesive transfer tape or adhesive stickyback may be added to the Mylar portion or other backing on the back portion 6 of the soft secondary plate 14. Suitable adhesive stickyback is available from a variety of commercial suppliers. In one embodiment, the adhesive stickyback is about 2.0 mil (or about 0.002 inch) thick. In another embodiment, the adhesive stickyback is about 15 mil (or about 0.015 inch) thick. The soft secondary plate 14 with the stickyback on the back portion 6 is then attached to the blanket cylinder of the decorator.

Although not illustrated in FIGS. 1-4, it will be appreciated by one of skill in the art that one or more of the printing plates 2 and/or the soft secondary plates 14 may have print registration areas that are used to monitor the registration of different colors or specialty inks printed by different plates 2, 14 to form an image on the metallic container. For example, print registration areas may be provided on the printing plates 2 and/or the soft secondary plates 14 to monitor the location and alignment of print content on metallic containers.

Figure 5:
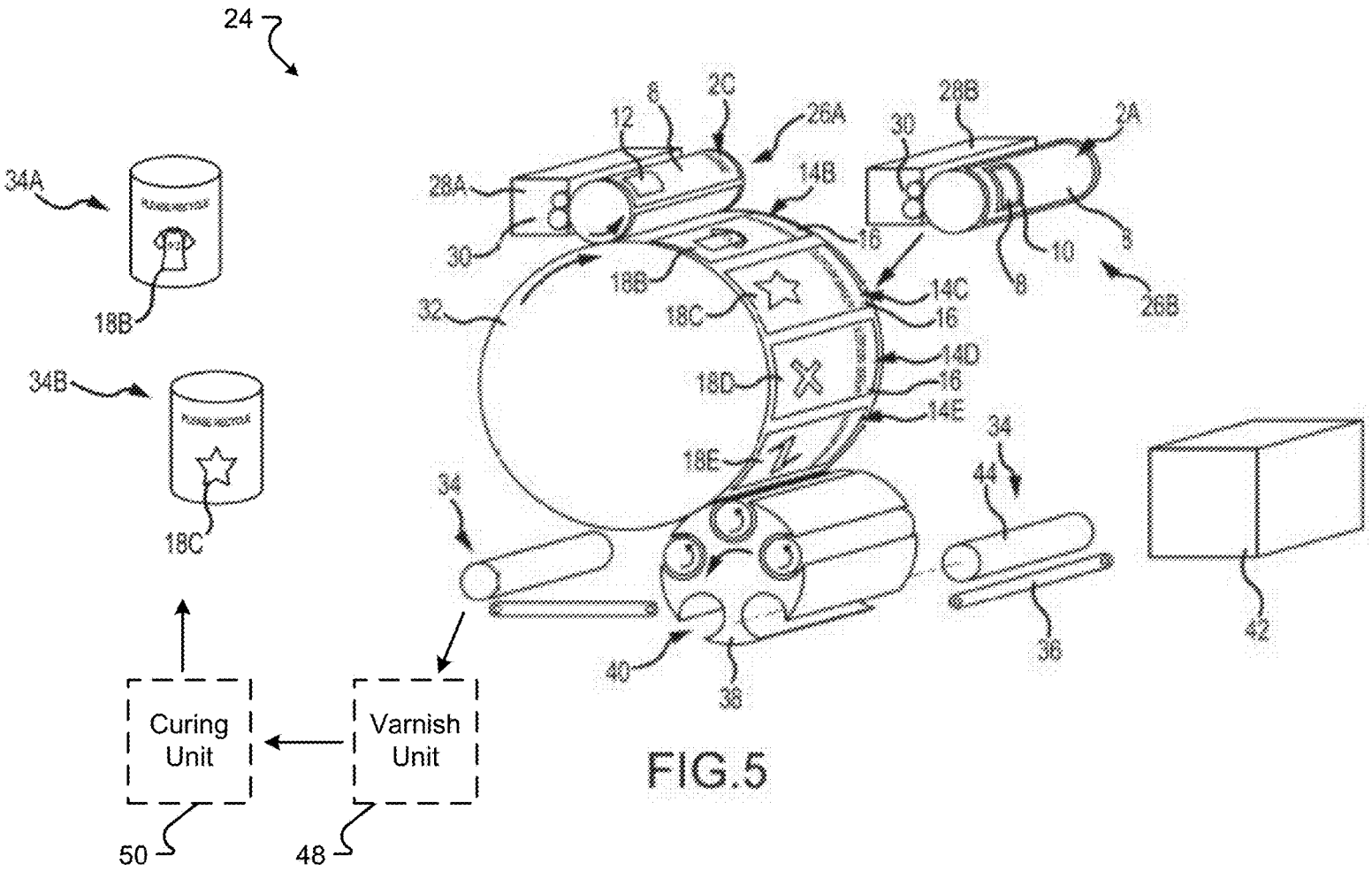
FIG. 5 is a schematic illustration of one embodiment of a decorator of the present invention using soft secondary plates to decorate metallic containers.

Referring now to FIG. 5, a decorator 24 using soft secondary plates 14 and specialty inks to form multiple images on metallic containers 34 is illustrated. The decorator 24 includes at least one plate cylinder 26. One or more printing plates 2 are attached to each of the plate cylinders 26. Additionally or alternatively, the printing plate 2 can be a sleeve or cylinder that wraps around a circumference of the plate cylinder 26. The plate cylinders 26 are operable to rotate in a first direction. Inkers 28 with rollers 30 are associated with each plate cylinder 26. The rollers 30 of each inker 28 transfer one color of ink or type of specialty ink to the ink receiving regions 8 of the printing plates 2.

As discussed herein, specialty inks include, but are not limited to, a thermochromic ink, a photochromic ink, a scented thermochromic ink, a fluorescent ink, a UV ink, a glow-in-the-dark ink, a black light ink, an infrared ink, a phosphorescent ink, a pressure sensitive ink, a tactile ink, a tactile thermochromic ink, a leuco dye, a matte ink, and any other type of ink, dye, or varnish that changes appearance, color, and/or texture in response to temperature changes or exposure to light or pressure. Specialty inks and methods of using them are disclosed in U.S. Pat. Nos. 4,889,560, 5,502,476, 5,591,255, 5,919,839, 6,139,779, 6,174,937, 6,196,675, 6,309,453, 6,494,950, 7,810,922, 8,409,698, U.S. Patent Application Publication 2012/0238675, U.S. Patent Application Publication 2013/0075675, U.S. Patent Application Publication 2013/0105743, U.S. Patent Application Publication 2013/0231242, U.S. Patent Application Publication 2012/0315412, U.S. Patent Application Publication 2013/0340885, U.S. Patent Application Publication 2014/0039091, U.S. Patent Application Publication 2014/0072442, U.S. Patent Application Publication 2014/0187668, U.S. Patent Application Publication 2014/0210201, U.S. Patent Application Publication 2014/0212654, U.S. Patent Application Publication 2014/0272161, and International Publication No. WO 2014/096088 which are each incorporated herein in their entirety by reference.

A first color of ink or type of specialty ink may be applied to the printing plates of the first plate cylinder 26A and a second color of ink or type of specialty ink may be applied to the printing plates of the second plate cylinder 26B. More colors of ink and types of specialty ink may be used if additional plate cylinders 26 are provided. In one embodiment, the decorator 24 includes from 4 to 18 plate cylinders 26 and from 4 to 18 inkers 28 each operable to apply a different color of ink or type of specialty ink to a predetermined portion of a printing plate 2. In a more preferred embodiment, the decorator includes from 6 to 18 plate cylinders and from 6 to 18 inkers each operable to apply a different color of ink or type of specialty ink to a predetermined portion of a printing plate 2.

In the example illustrated in FIG. 5, the printing plates 2 of the first plate cylinder 26A include common content, an image in the form of the words "Please Recycle," in ink receiving regions 8 that will be transferred to all of the soft secondary plates 14. However, as will be appreciated by one of skill in the art, the printing plates do not have to include an image. For example, the printing plates can transfer ink to the soft secondary plates 14 without transferring an image to the soft secondary plates. The first and second plate cylinder 26A, 26B can include printing plates 2 with one or more relief areas 12 and non-ink regions 10. In one embodiment, a relief area 12 may be formed in the same location of all of the printing plates 2 except for one printing plate which does not have a relief area. The relief areas 12 formed in the printing plates 2 do not receive ink from the inkers 28 and will not transfer ink to the secondary plates 14. The one printing plate 2 without a relief area will transfer ink to all images 18 and ink receiving regions 16 of the soft secondary plates 14 that contact the ink receiving regions 8 of the face portion 4 of the one printing plate 2 without a relief area. Additionally or alternatively, one or more printing plates 2 can transfer different colors of ink and types of specialty ink to the same location of the soft secondary plates 14. Thus, different colors of ink and types of specialty ink may be transferred from one or more printing plates 2 to the same location of the soft secondary plates 14 in overlapping layers.

The decorator 24 also includes a blanket cylinder 32 to which one or more soft secondary plates 14 are attached. Additionally or alternatively, the one or more soft secondary plates 14 can be a sleeve or cylinder of a soft photopolymer material or a sleeve of rubber that wraps around the circumference of the blanket cylinder 32. The blanket cylinder 32 rotates in a second direction opposite to the first direction of the plate cylinder 26. Each soft secondary plate 14 may have a different image 18 formed thereon. For example, the soft secondary plates 14 illustrated in FIG. 5 include an image 18B of a sports jersey, an image 18C of a star, an image 18D of an "X," and an image 18E of a lightning bolt formed thereon. The images 18 on the soft secondary plates 14 can be formed in locations corresponding to, or aligning with, the relief areas 12 of the printing plates 2. The images 18 of the soft secondary plates 18 may be negatives (formed by relief areas 20 that will not receive ink) that leave non-inked areas on the decorated metallic container 34, or the images 18 may be positives that will receive ink when the images 18 contact one or more ink receiving regions 8 of the printing plates 2 that have received ink from an inker 28. For a soft secondary plate 14 formed at least partially of a photopolymer material, a positive portion of an image is formed by exposed, hardened areas of the soft photopolymer plates 14. The positive portions of an image formed on a soft secondary plate 14 formed at least partially of rubber comprise the portions of the face 4 of a soft secondary plate 14 that are not removed during the image forming process or areas adapted to attract ink. The images 18 can also include combinations of negative and positive areas. It will be understood by those of skill in the art that a positive image will apply ink to a metallic container and a negative image means an absence of ink in a printed or positive part of an image.

The plate cylinders 26 rotate in the first direction and the blanket cylinder 32 rotates in the second opposite direction in unison to bring the printing plates 2 into contact with the soft secondary plates 14. Ink is transferred to the ink receiving regions 16 and images 18 of the soft secondary plates 14 that contact the inked ink receiving regions 8 of the printing plates 2. The main image exposure occurs on the inked printing plates 2 and a secondary image is produced by the soft secondary plates 14. The soft secondary plates 14 may have ink receiving regions 16 that are common for all of the soft secondary plates 14. The areas where images 18 are formed on the soft secondary plates, such as the images 18A, 18B illustrated in FIGS. 4A and 4B, will create unique inked areas for each soft secondary plate 14. The process is similar to a stamp ink pad and rubber stamp where only the raised portion of the rubber stamp collects ink from the ink pad and transfers the ink to a substrate as an image. Relief areas 20 of the soft secondary plates 14 will not receive ink from the printing plates 2. Only the images 18 or the ink receiving regions 16 of the soft secondary plates 14 will receive ink from the printing plates 2 and transfer the ink onto the surface of the metallic containers. By using soft secondary plates 14 with different images 18 formed thereon a completely different image will be printed on each metallic container. This results in multiple lithographic images being produced from a single set of printing plates 2 on the plate cylinders 26 of the decorator 24. The process uses high-definition solid and screened images formed on the soft secondary plates 14 resulting in unique ink transfer to metallic containers.

In operation, a metallic container 34 is fed to a support cylinder 38 by a conveyor 36 or other means from a storage location or facility 42. The support cylinder 38 has a plurality of stations 40 adapted to receive and hold a metallic container 34 in a predetermined position aligned with the soft secondary plates 14. The stations 40 can hold the metallic containers 34 in a stationary position and can also rotate the metallic containers 34 about each container's longitudinal axis. As the blanket cylinder 32 rotates in the second direction, the support cylinder 38 rotates in unison in the first direction to bring an exterior surface 44 of the metallic container 34 into rotational contact with an inked soft secondary plate 14 attached to the blanket cylinder 32. The ink is then transferred from the soft secondary plate 14 to the exterior surface 42 of the metallic container 34. Although a support cylinder 38 is illustrated in FIG. 5, it should be understood that other means of supporting the metallic containers 34 and bringing the exterior surface 44 of them into contact with the soft secondary plates 14 may be used, such as a mandrel wheel or a conveyor belt. After the ink is transferred to the metallic container 34, a varnish unit 48 may optionally apply an over varnish to the metallic container 34. The over varnish may comprise a specialty ink. If necessary, the ink and/or the over varnish may be cured by a curing unit 50 by any method known to those of skill in the art. In one embodiment, the curing unit 50 may use one or more of thermal energy, ultraviolet energy, and an electron beam to cure the ink and/or the over varnish on the metallic container 34.

Two decorated metallic containers 34A, 34B are also illustrated in FIG. 5. The decorated metallic containers include an image of common content ("Please Recycle") which is transferred from the printing plate 2C. Container 34A includes unique content, the image 18B of a sports jersey, and container 34B includes a unique image 18C of a star. Decorators 24 used in the commercial metallic container industry generally have blanket cylinders 32 with between about 4 to 12 individual soft secondary plates 14 attached. When each of the 4 to 12 individual soft secondary plates 14 has a unique image 18 formed thereon, the decorator 24 can produce from 4 to 12 different lithographic images without changing the printing plates 2. The present invention will work with a blanket cylinder 32 with any number of soft secondary plates 14 attached to its circumference. In addition, although the soft secondary plates 14 are illustrated in FIG. 5 as individual secondary plates, in some embodiments the blanket cylinder 32 may have one continuous blanket of a photopolymer material or rubber affixed to its circumference, the continuous blanket having multiple unique images formed thereon. In another embodiment, one or more soft secondary plates comprised at least partially of rubber and one or more soft secondary plates comprised at least partially of a photopolymer material may be attached to the blanket cylinder 32 at the same time. Each of the rubber soft secondary plates or the soft photopolymer plates may have one or more different images 18 formed thereon. In another embodiment, printing plates 2 formed of rubber or a soft photopolymer material may be attached to one or more of the plate cylinders 26. Each of the rubber printing plates or the photopolymer printing plates may have one or more ink receiving regions 8, non-ink regions 10, and relief areas 12 that form an image.

Referring now to FIG. 6A, a photograph of a soft secondary plate 14F comprised of a photopolymer material is provided. The soft secondary plate 14F includes an image 18 of a sports jersey with the number "92" formed thereon according to various embodiments of the present invention. FIG. 6B is an enlarged photograph of the image 18 of FIG. 6A. In the embodiment illustrated in FIGS. 6A and 6B, the image 18 is not surrounded by a relief area.

Figure 7B:
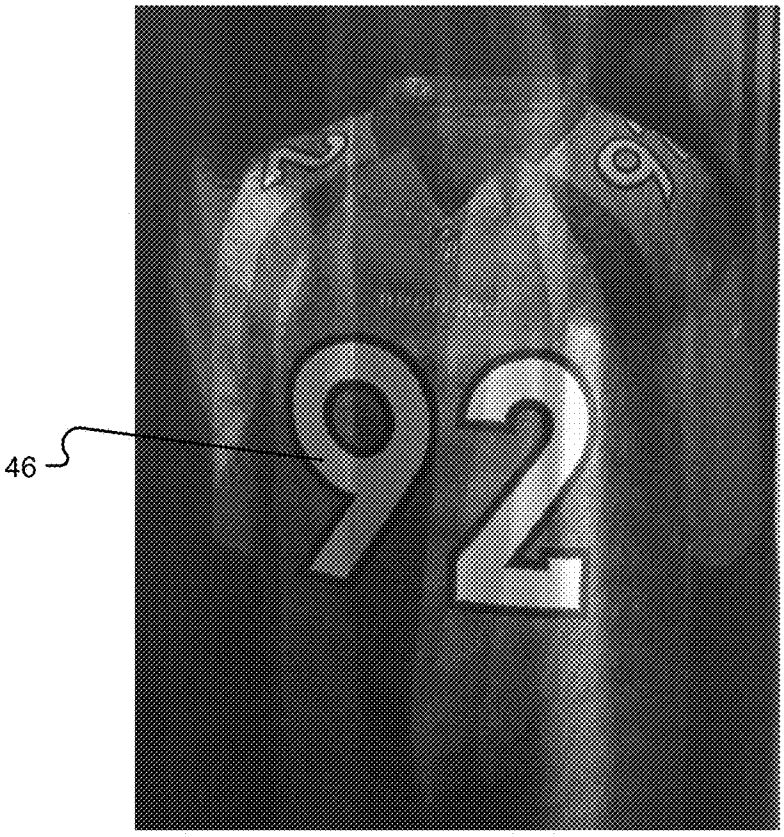
FIG. 7B is an enlarged photograph of the metallic can of FIG. 7A.
Figure 7A:
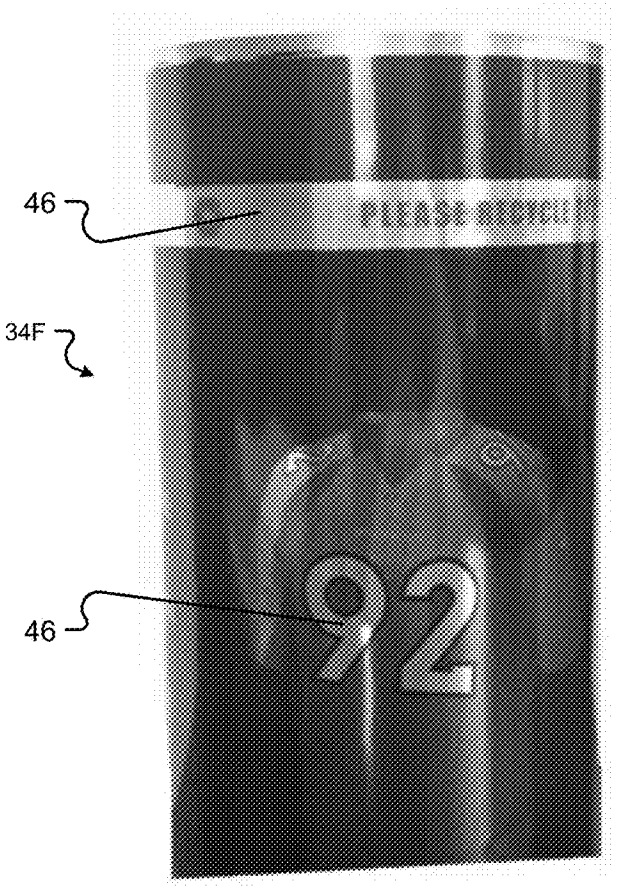
FIG. 7A is a photograph of a metallic container decorated according to various embodiments of the present invention using the soft secondary plate of FIG. 6A.

Referring now to FIG. 7A, a photograph of a generally cylindrical metallic container 34F decorated according to various embodiments of the present invention with the soft secondary plate 14F shown in FIG. 6A is provided. FIG. 7B is an enlarged portion of the photograph of FIG. 7A. The photographs show a generally cylindrical metallic container 34F decorated with a sports jersey which includes the number "92" formed in a non-inked portion 46 (or negative) of the decoration. Other numbers, shapes, words, or designs could be formed to decorate a substrate using the present invention.

Figure 8:
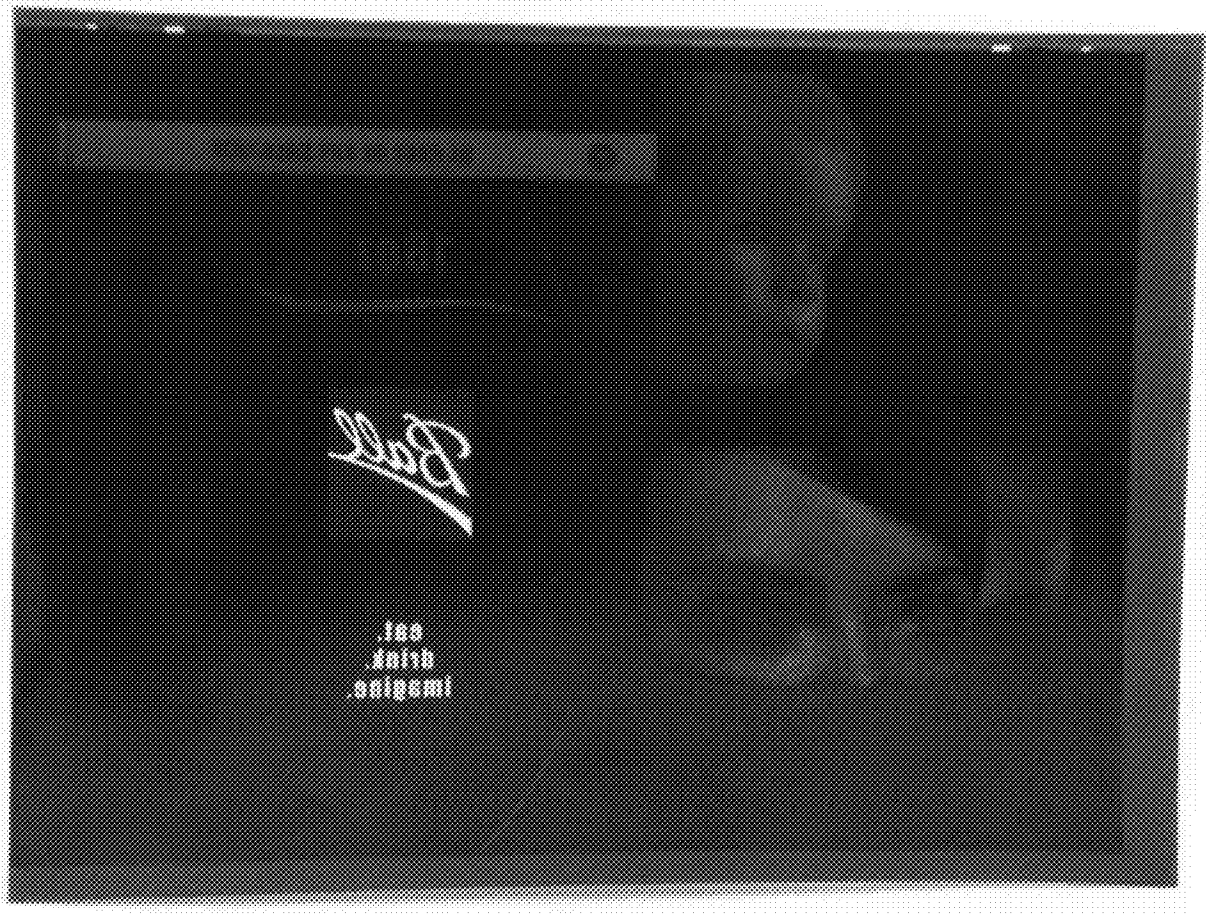
FIG. 8 is a photograph of a soft secondary plate comprised of a photopolymer material with images formed thereon according to various embodiments of the present invention.
Figure 9:
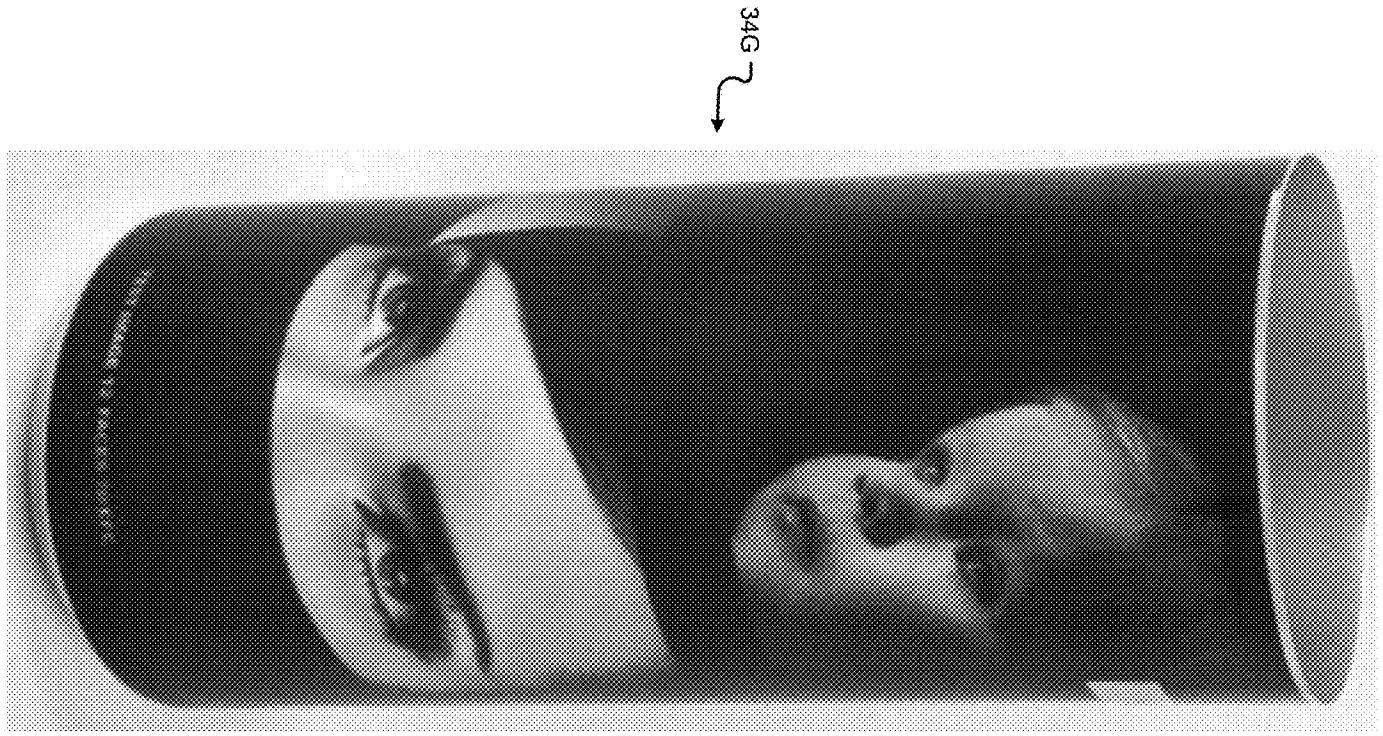
FIG. 9 is a photograph of a metallic container decorated according to various embodiments of the present invention using the soft secondary plate of FIG. 8.
Figure 10A:
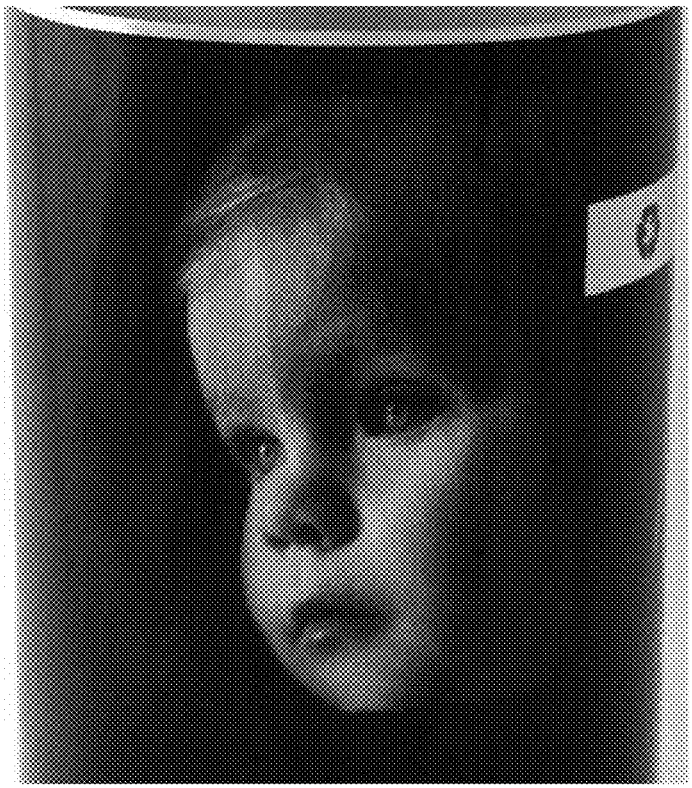
FIG. 10A is an enlarged photograph of a first image formed on the metallic container of FIG. 9 using the soft secondary plate of FIG. 8.
Figure 10B:
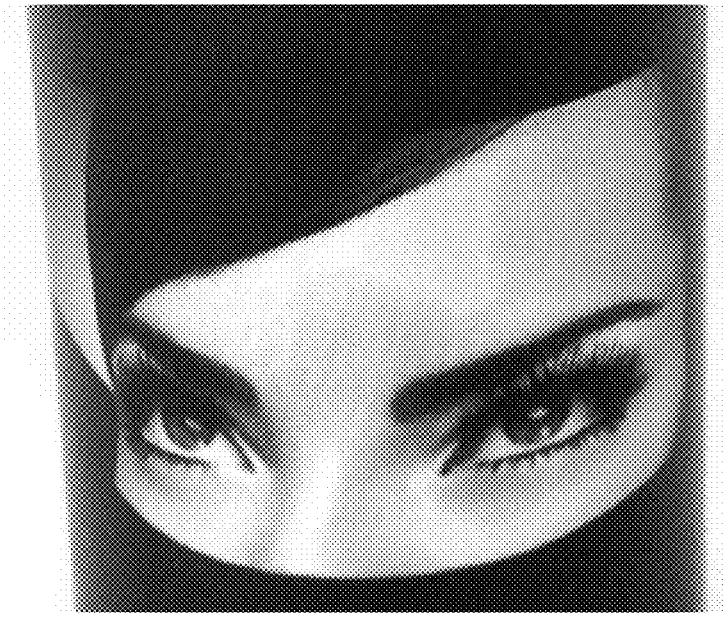
FIG. 10B is a second enlarged photograph of a second image formed on the metallic container of FIG. 9 using the soft secondary plate of FIG. 8.

Referring now to FIG. 8, a photograph of another soft secondary plate 14G with several images formed thereon according to various embodiments of the present invention is provided. The soft secondary plate 14G is comprised of a photopolymer material. A photograph of a generally cylindrical metallic container 34G decorated according to various embodiments of the present invention using the soft secondary plate 14G of FIG. 8 is shown in FIG. 9. FIGS. 10A and 10B provide enlarged photographs of a first image and a second image formed on the metallic container 34G shown in FIG. 9.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. An apparatus for forming a high-definition lithographic image on an exterior surface of a metallic container, comprising:

a first plate cylinder;

a first printing plate attached to a circumference of the first plate cylinder;

a first inker operable to transfer a first ink to the first printing plate;

a second plate cylinder;

a second printing plate attached to a circumference of the second plate cylinder, the second printing plate including a relief area;

a second inker operable to transfer a second ink to the second printing plate;

a blanket cylinder;

a flexible transfer plate comprised of a saturated chain of polymethylene affixed to the blanket cylinder, the flexible transfer plate including a first image that aligns with the relief area of the second printing plate, wherein the blanket cylinder is operable to move the flexible transfer plate into contact with the first and second printing plates such that the first ink is transferred from the first printing plate to the first image and the second ink is transferred from the second printing plate to a portion of the flexible transfer plate; and a support cylinder operable to move the metallic container into contact with the flexible transfer plate affixed to the blanket cylinder, wherein the first and second inks are transferred from the flexible transfer plate to the exterior surface of the metallic container to form the high-definition lithographic image.

2. The apparatus of claim 1, wherein at least some of a material of the flexible transfer plate has been removed to form the first image.

3. The apparatus of claim 1, wherein the first ink comprises at least one of a thermochromic ink, a photochromic ink, a scented thermochromic ink, a fluorescent ink, a UV ink, a black light ink, an infrared ink, a phosphorescent ink, a pressure sensitive ink, a tactile ink, a thermo-tactile ink, a leuco dye, and a matte ink.

4. The apparatus of claim 1, wherein the saturated chain of polymethylene is an ethylene propylene rubber.

5. The apparatus of claim 1, wherein the saturated chain of polymethylene is an M-class rubber.

6. The apparatus of claim 1, wherein the saturated chain of polymethylene is an ethylene propylene diene monomer.

7. The apparatus of claim 1, wherein at least a portion of the first image has a depth that is lower than a plane defined by a face portion of the flexible transfer plate.

8. A decorator to decorate an exterior surface of a plurality of metallic containers with different images, comprising:

a first plate cylinder with a first printing plate which includes a first ink receiving region and a relief area that will not receive ink;

a first inker to transfer a first ink to the first ink receiving region;

a second plate cylinder with a second printing plate which includes a second ink receiving region;

a second inker to transfer a second ink to the second ink receiving region;

a blanket cylinder rotationally aligned with the first and second plate cylinders;

a first transfer plate with a first image affixed to the blanket cylinder, the first transfer plate comprised of a saturated chain of polymethylene; and a second transfer plate with a second image affixed to the blanket cylinder, wherein the relief area of the first printing plate aligns with the first and second images, and wherein the blanket cylinder is operable to rotate with respect to the first and second plate cylinders such that the first ink receiving region of the first printing plate transfers the first ink to a portion of each of the first and second transfer plates and the second ink receiving region of the second printing plate transfers the second ink to the first and second images, and wherein, as the blanket cylinder continues rotating, the first transfer plate contacts an exterior surface of a first metallic container which is decorated with the first ink and with the first image and the second transfer plate contacts an exterior surface of a second metallic container which is decorated with the first ink and with the second image.

9. The decorator of claim 8, wherein at least some of a face portion of the first transfer plate is removed to form the first image.

10. The decorator of claim 8, wherein at least a portion of the first image has a depth that is lower than a first plane defined by a face portion of the first transfer plate and no portion of the first image projects above the first plane.

11. The decorator of claim 8, wherein the first image of the first transfer plate is surrounded by a relief area that will not receive ink from the first and second printing plates such that the first image formed on the first metallic container is surrounded by a non-inked area.

12. The decorator of claim 8, further comprising a support cylinder to move the first and second metallic containers into contact with the first and second transfer plates.

13. The decorator of claim 8, wherein the saturated chain of polymethylene of the first transfer plate is an M-class rubber.

14. The decorator of claim 8, wherein the saturated chain of polymethylene of the first transfer plate is an ethylene propylene rubber.

15. The decorator of claim 8, wherein the saturated chain of polymethylene of the first transfer plate is an ethylene propylene diene monomer.

16. A decorator with transfer plates to decorate an exterior surface of a generally cylindrical container, comprising:

a blanket cylinder;

a first transfer plate affixed to the blanket cylinder, the first transfer plate including a first image with at least a portion of the first image having a depth that is lower than a first plane defined by a face portion of the first transfer plate and no portion of the first image projects above the first plane, wherein the first transfer plate is comprised of a saturated chain of polymethylene;

a first plate cylinder;

a first printing plate interconnected to the first plate cylinder, wherein the first printing plate is operable to transfer a first ink to at least a portion of the first transfer plate;

a second plate cylinder;

a second printing plate interconnected to the second plate cylinder, the second printing plate including a second image, wherein the second printing plate is operable to transfer a second ink from the second image to the first transfer plate, and wherein the second printing plate does not transfer the second ink to the first image; and a support element to move a first container into contact with the first transfer plate, wherein the first and second inks are transferred from the first transfer plate to an exterior surface of the first container to form the first and second images on the first container.

17. The decorator of claim 16, wherein the saturated chain of polymethylene of the first transfer plate comprises at least one of:

an ethylene propylene rubber;

an M-class rubber; and an ethylene propylene diene monomer.

18. The decorator of claim 16, wherein the first image on the first transfer plate is a negative comprising relief areas that will not receive the first ink from the first printing plate.

19. The decorator of claim 16, further comprising a second transfer plate affixed to the blanket cylinder, the second transfer plate including a third image, wherein the first printing plate is operable to transfer the first ink to at least a portion of the second transfer plate and the second printing plate is operable to transfer the second ink from the second image to the second transfer plate, wherein the second printing plate does not transfer the second ink to the third image, and wherein the first and second inks are subsequently transferred from the second transfer plate to an exterior surface of a second container to form the second and third images on the second container.

20. The decorator of claim 16, wherein the first image on the exterior surface of the first container is formed of the first ink and the second image on the exterior surface of the first container is formed of the second ink.

* * * * *